US005352571A

United States Patent [19]

Suzuki et al.

[11] Patent Number: 5,352,571

[45] Date of Patent: * Oct. 4, 1994

[54] SILVER HALIDE COLOR PHOTOGRAPHIC LIGHT-SENSITIVE MATERIAL

[75] Inventors: Makoto Suzuki; Hideaki Naruse; Takehiko Sato, all of Kanagawa, Japan

[73] Assignee: Fuji Photo Film Co., Ltd., Kanagawa, Japan

[ * ] Notice: The portion of the term of this patent subsequent to Nov. 27, 2009 has been disclaimed.

[21] Appl. No.: 982,578

[22] Filed: Nov. 27, 1992

[30] Foreign Application Priority Data

Nov. 27, 1991 [JP] Japan ..... 3-311213

[51] Int. Cl.[5] ..... G03C 7/38; G03C 7/396

[52] U.S. Cl. ..... 430/545; 430/546; 430/558; 430/627; 430/631

[58] Field of Search ..... 430/558, 384, 385, 546, 430/545, 631, 627

[56] References Cited

U.S. PATENT DOCUMENTS

| | | | |
|---|---|---|---|
| 4,873,183 | 10/1989 | Tachibane et al. | 430/558 |
| 4,910,127 | 3/1990 | Sakaki et al. | 430/558 |
| 5,006,453 | 4/1991 | Takahashi et al. | 430/558 |
| 5,055,386 | 10/1991 | Hirano et al. | 430/546 |
| 5,071,738 | 12/1991 | Mizukura et al. | 430/546 |
| 5,091,297 | 2/1992 | Fukunaga et al. | 430/558 |
| 5,256,526 | 10/1993 | Suzuki et al. | 430/558 |

FOREIGN PATENT DOCUMENTS

| | | | |
|---|---|---|---|
| 0249453 | 12/1987 | European Pat. Off. . | |
| 0488248 | 6/1992 | European Pat. Off. . | |
| 0491197 | 6/1992 | European Pat. Off. . | |
| 1456278 | 11/1976 | United Kingdom | 430/546 |

OTHER PUBLICATIONS

Mees, 1966, The Theory of the Photographic Process, 3 ed. p. 187.

*Primary Examiner*—Lee C. Wright
*Attorney, Agent, or Firm*—Sughrue, Mion, Zinn, Macpeak & Seas

[57] ABSTRACT

A silver halide color photographic light-sensitive material capable of providing a dye image having improved spectral absorption characteristic as well as high color-forming property and excellent dye image fastness is disclosed. The light-sensitive material comprises at least one silver halide emulsion layer having a cyan color-forming property, wherein the silver halide emulsion layer having the cyan color-forming property contains at least one cyan coupler represented by the following formula (I) or (II) and at least one of a sparingly water-soluble homopolymer and/or copolymer:

(I)

(II)

wherein Za and Zb each represents —C($R_3$)= or —N=, provided that one of Za and Zb is —N= and the other is —C($R_3$)=; $R_1$ and $R_2$ each are an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; and X represents a hydrogen atom or a group capable of splitting off upon a reaction with an oxidation product of an aromatic primary amine color developing agent.

15 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material (hereinafter referred to simply as a light-sensitive material), more specifically to a silver halide color photographic light-sensitive material which provides a dye image having improved spectral absorption characteristic as well as high color-forming property and excellent dye image fastness.

BACKGROUND OF THE INVENTION

A silver halide color photographic light-sensitive material is subjected to an imagewise exposure and then to development with an aromatic primary amine type color development agent to result in generating an oxidation product of the developing agent, which reacts with a dye-forming coupler (hereinafter referred to as a coupler) to thereby form a dye image. In the silver halide color photographic light-sensitive material, usually used as the coupler are a yellow coupler, a cyan coupler and a magenta coupler in combination. The dyes formed by these couplers have undesired sub-absorptions in many cases, and in employing them for a multi-layer constitutional silver halide color photographic light-sensitive material, the color reproducibility thereof is inclined to be deteriorated. Accordingly, there have so far been proposed the use of couplers which form an image with less sub-absorption.

Above all, a phenol type or naphthol type cyan coupler is generally used for forming a cyan dye image. However, the dyes formed by these couplers have unfavorable absorptions in the range of 400 to 450 nm and therefore have the serious problem that color reproducibility is markedly deteriorated. Accordingly, the solution of this problem is desired.

There are proposed as a means for solving this problem, cyan couplers such as pyrazoloazoles described in U.S. Pat. No. 4,873,183 and 2,4-diphenyimidazoles described in EP249,453A2. The dyes formed by these couplers have less unfavorable absorptions in a short wavelength region as compared with the dyes formed by the conventional cyan couplers. However, these couplers are not deemed to have enough color reproducibilities and in addition, there still remain problems that coupling activity is low and that fastness to heat and light is notably low. Further, a dye image faded by heat and light leads to a deteriorated color reproducibility.

In recent years, further higher performances are requested color reproducibility and fastness of a dye image obtained, and the light-sensitive material satisfying an excellent color reproducibility and having a superior fastness of a dye image is desired.

SUMMARY OF THE INVENTION

An object of the present invention is to provide a silver halide color photographic light-sensitive material capable of forming a dye image having an improved spectral absorption characteristic and excellent color reproducibility as well as high color-forming property and a high fastness to heat and light.

The above and other objects of the present invention have been achieved by a silver halide color photographic light-sensitive material comprising a support having provided thereon at least one silver halide emulsion layer having a cyan color-forming property, wherein the silver halide emulsion layer having the cyan color-forming property contains at least one cyan coupler represented by the following formula (I) or (II) and at least one of a sparingly water-soluble homopolymer and/or copolymer:

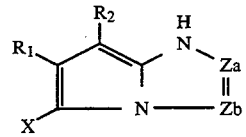

(I)

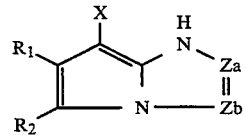

(II)

wherein Za and Zb each represents —C($R_3$)= —N=, provided that one of Za and Zb is —N= and the other is —C($R_3$)=; $R_1$ and $R_2$ each are an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; and X represents a hydrogen atom or a group capable of splitting off upon a reaction with an oxidation product of an aromatic primary amine color developing agent.

The present invention provides a silver halide color photographic light-sensitive material capable of forming a color image having an excellent color reproducibility as well as high color-forming property and high light and heat fastness.

DETAILED DESCRIPTION OF THE INVENTION

The present invention will be explained below in detail.

The cyan coupler of the present invention represented by formula (I) or (II) will be described below in detail.

Za and Zb each represent —C($R_3$)= or —N=, provided that when either one of Za and Zb is —N= the other is —C($R_3$)=. The cyan couplers of the present invention are represented by the following formulas (I-a), (I-b), (II-a) or (II-b):

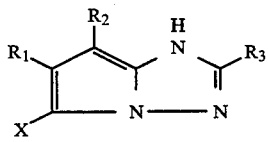

(I-a)

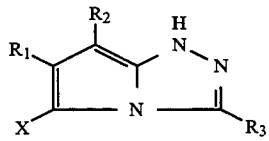

(I-b)

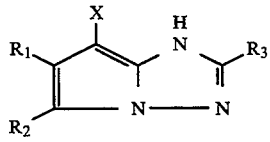

(II-a)

-continued

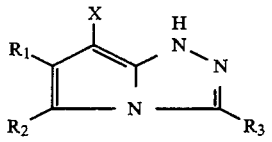

(II-b)

wherein $R_1$, $R_2$, $R_3$ and X represent the same ones as those defined for $R_1$, $R_2$, $R_3$ and X in formulas (I) and (II), respectively.

$R_3$ represents a hydrogen atom or a substituent, said substituent including, a halogen atom, an alkyl group, an aryl group, a heterocyclic group, a cyano group, a hydroxy group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. These groups may further be substituted with the substituents exemplified in $R_3$.

More specifically, $R_3$ represents a hydrogen atom, a halogen atom (for example, a chlorine atom and a bromine atom), an alkyl group (for example, a linear or branched alkyl group having 1 to 32 carbon atoms, an aralkyl group, an alkenyl group, an alkynyl group, a cycloalkyl group, and a cycloalkenyl group, and to be more detailed, methyl, ethyl, propyl, isopropyl, t-butyl, tridecyl, 2-methanesulfonylethyl, 3-(3-pentadecylphenoxy) propyl, 3-[4-{2-[4-(4-hydroxyphenylsulfonyl) phenoxy] dodecanamido} phenyl] propyl, 2-ethoxytridecyl, trifluoromethyl, cyclopentyl, and 3-(2,4-di-t-amylphenoxy) propyl), an aryl group (for example, phenyl, 4-t-butylphenyl, 2,4-di-t-amylphenyl, and 4-tetradecanamidophenyl), a heterocyclic group (for example, 2-furyl, 2-thienyl, 2pyrimidinyl, and 2-benzothiazolyl), a cyano group, a hydroxy group, a nitro group, a carboxyl group, a sulfo group, an amino group, an alkoxy group (for example, methoxy, ethoxy, 2-methoxyethoxy, 2-dodecylethoxy, and 2-methanesulfonylethoxy), an aryloxy group (for example, phenoxy, 2-methylphenoxy, 4-t-butylphenoxy, 3-nitrophenoxy, 3-t-butyloxycarbamoyl-phenoxy, and 3-methoxycarbamoyl-phenoxy), an acylamino group ( for example, acetamido, benzamido, tetradecanamido, 2-(2,4-di-t-amylphenoxy) butanamido, 4 -(3-t-butyl-4-hydroxyphenoxy) butanamido, and 2-[4-(4-hydroxyphenyl-sulfonyl) phenoxy] decanamido), an alkylamino group ( for example, methylamino, butylamino, dodecylamino, diethylamino, and methylbutylamino), an anilino group (for example, phenyl-amino, 2-chloranilino, 2-chloro-5-tetradecanaminoanilino, 2-chloro-5-dodecyloxycarbonylanilino, N-acetylanilino, and 2-chloro-5-[2-(3-t-butyl-4-hydroxyphenoxy) dodecanamido] anilino), a ureido group (for example, phenylureido, methylureido, and N,N-dibutylureido), a sulfamoylamino group (for example, N,N-dipropylsulfamoylamino, and N-methyl-N-decyl-sulfamoylamino), an alkylthio group (for example, methylthio, octylthio, tetradecylthio, 2-phenoxyethylthio, 3-phenoxypropylthio, and 3-(4-t-butyl-phenoxy) propylthio), an arylthio group (for example, phenylthio, 2-butoxy-5-t-octylphenylthio, 3-pentadecyl-phenylthio, 2carboxyphenylthio and 4-tetradecanamido-phenylthio ), an alkoxycarbonylamino group (for example, methoxycarbonylamino and tetradecyloxycarbonylamino ), a sulfonamido group (for example, methanesulfonamido, hexadecanesulfonamido, benzenesulfonamido, p-toluene-sulfonamido, octadecanesulfonamido, and 2-methoxy-5-t-butylbenzenesulfonamido), a carbamoyl group (for example, N-ethylcarbamoyl, N,N -dibutylcarbamoyl, N-(2-dodecyloxyethyl ) carbamoyl, N-methyl-N-dodecylcarbamoyl, and N-[3-(2,4-di-t-amylphenoxy) propyl] carbamoyl) , a sulfamoyl group ( for example, N-ethylsulfamoyl, N,N-dipropyl-sulfamoyl, N-(2-dodecyloxyethyl), sulfamoyl, N-ethyl-N-dodecylsulfamoyl, and N,N-diethylsulfamoyl), a sulfonyl group (for example, methanesulfonyl, octanesulfonyl, benzenesulfonyl, and toluenesulfonyl), an alkoxycarbonyl group (for example, methoxycarbonyl, butyloxycarbonyl, dodecyloxycarbonyl, and octadecyloxycarbonyl), a heterocyclic oxy group (for example, 1-phenyltetrazole-5-oxy, and 2-tetrahydropyranyloxy), an azo group (for example, phenylazo, 4-methoxyphenylazo, 4-pivaloylaminophenylazo, and 2-hydroxy-4-propanoylphenylazo),an acyloxy group (for example, acetoxy), a carbamoyloxy group (for example, N-methylcarbamoyloxy and N-phenylcarbamoyloxy), a silyloxy group (for example, trimethylsilyloxy and dibutylmethylsilyloxy), an aryloxycarbonylamino group (for example, phenoxycarbonylamino), an imido group (for example, N-succinimido, N-phthalimido, and 3-octadecenylsuccinimido), a heterocyclic thio group (for example, 2-benzothiazolyl-thio, 2,4-di-phenoxy-1,3,5-triazole-6-thio, and 2-pyridylthio), a sulfinyl group (for example, dodecanesulfinyl, 3-pentadecylphenyl-sulfinyl, and 3-phenoxypropylsulfinyl), a phosphonyl group (for example, phenoxyphosphonyl, octyloxy-phosphonyl, phosphonyl, and phenylphosphonyl), an aryloxycarbonyl group (for example, phenoxycarbonyl), an acyl group (for example, acetyl, 3-phenylpropanoyl, benzoyl, and 4-dodecyloxybenzoyl), and an azolyl group (for example, imidazolyl, pyrazolyl, 3-chloropyrazole-1-yl, and triazolyl).

Preferred substituents of $R_3$ include, an alkyl group, an aryl group, a heterocyclic group, a cyano group, a nitro group, an acylamino group, an anilino group, a ureido group, a sulfamoylamino group, an alkylthio group, an arylthio group, an alkoxycarbonyl-amino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, and an azolyl group.

$R_3$ is further preferably an alkyl group or an aryl group. It is more preferably an alkyl group or aryl group having at least one substituent from the viewpoint of a flocculation property, and further preferably an alkyl group or aryl group each having at least one alkoxy group, sulfonyl group, sulfamoyl group, carbamoyl group, acylamido group, or sulfonamido group as a substituent. $R_3$ is particularly preferred to be an alkyl group or aryl group each having at least one acylamido group or sulfonamido group as a substituent. These substituents substituted on the aryl group are more preferably substituted at least on an ortho position. The alkyl group is more preferably a secondary or tertiary alkyl group which is branched at the $\alpha$ position.

In the cyan coupler of the present invention, $R_1$ and $R_2$ each are an electron attractive group having the $\sigma_p$ value of 0.2 or more, and the value of 0.65 or more in the total of the $\sigma_p$ values of $R_1$ and $R_2$ makes it possible to develop a color to form a cyan dye image. The total of the $\sigma_p$ values of $R_1$ and $R_2$ is preferably 0.70 or more and the upper limit thereof is not much more than 1.8.

$R_1$ and $R_2$ each are an electron attractive group having the Hammett's substituent constant $\sigma_p$ of 0.20 or more, preferably 0.30 or more. The upper limit thereof is 1.0 or less. Hammett's rule was proposed by L. P. Hammett in 1935 in order to quantitatively discuss the affects exerted to a reaction or equilibrium of a benzene derivative by a substituent. This rule is well known and widely accepted in the art.

The $\sigma_p$ value and $\sigma_m$ value are available as the substituent constants obtained according to Hammett's rule and the values thereof are described in numerous publications, including, for example, *Lange's Handbook of Chemistry* vol. 12, edited by J. A. Dean, 1979 (McGrow-Hill) and *Chemical Region* (Kagaku no Ryoiki) No. 122, pp. 96 to 103, 1979 (Nankohdo). In the present invention, the respective groups are regulated and described by the Hammett's substituent constant $\sigma_p$ value but this does not mean that they are limited to the substituents in which the $\sigma_p$ values are described in these publications. It should be clear that even the $\sigma_p$ values of groups which are not described in these publications are included in the scope of the present invention as long as these values are included in the above range when they are measured according to Hammett's rule.

Examples of the groups represented by $R_1$ and $R_2$ which are electron attractive groups having the $\sigma_p$ values of 0.20 or more include, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, a halogenated alkyl group, a halogenated alkoxy group, a halogenated aryloxy group, a halogenated alkylamino group, a halogenated alkylthio group, an aryl group substituted with the other electron attractive group having $\sigma_p$ of 0.20 or more, a heterocyclic group, a halogen atom, an azo group, and a selenocyanato group. Of these substituents, the groups capable of further having the substituents may further have the substituents given for the groups defined for $R_3$.

More specifically, examples of the electron attractive groups having the $\sigma_p$ values of 0.20 or more include, an acyl group preferably having 1 to 50 carbon atoms (for example, acetyl, 3-phenylpropanoyl, benzoyl, and 4-dodecyloxybenzoyl), an acyloxy group preferably having 1 to 50 carbon atoms (for example acetoxy), a carbamoyl group preferably having 0 to 50 carbon atoms (for example, carbamoyl, N-ethylcarbamoyl, N-phenylcarbamoyl, N,N-dibutylcarbamoyl, N-(2-dodecyloxyethyl) carbamoyl,N-(4-n-pentadecanamido) phenylcarbamoyl, N-methyl-N-dodecylcarbamoyl, and N-[3-(2,4-di-t-amylphenoxy) propyl] carbamoyl), an alkoxycarbonyl group preferably having a straight chain, branched or cyclic alkyl moiety of 1 to 50 carbon atoms (for example, methoxycarbonyl, ethoxycarbonyl, isopropyloxycarbonyl, tert-butyloxycarbonyl, isobutyloxycarbonyl, butyloxycarbonyl, dodecyloxycarbonyl, and octadodecyloxycarbonyl), an aryloxycarbonyl group preferably having 6 to 50 carbon atoms (for example, phenoxycarbonyl), a cyano group, a nitro group, a dialkylphosphono group preferably having 2 to 50 carbon atoms (for example, dimethylphosphono), a diarylphosphono group preferably having 12 to 50 carbon atoms (for example, diphenylphosphono), a diarylphosphinyl group (for example, diphenylphosphinyl), an alkylsulfinyl group preferably having 1 to 50 carbon atoms (for example, 3-phenoxypropylsulfinyl), an arylsulfinyl group preferably having 6 to 50 carbon atoms (for example, 3-pentadecylphenylsulfinyl), an alkylsulfonyl group preferably having 1 to 50 carbon atoms (for example, methanesulfonyl and octanesulfonyl), an arylsulfonyl group preferably having 6 to 50 carbon atoms (for example, benzenesulfonyl and toluenesulfonyl), a sulfonyloxy group preferably having 1 to 50 carbon atoms (for example, methanesulfonyloxy and toluenesulfonyloxy), an acylthio group preferably having 1 to 50 carbon atoms (for example, acetylthio and benzoylthio), a sulfamoyl group preferably having 0 to 50 carbon atoms (for example, N-ethylsulfamoyl, N,N-dipropylsulfamoyl, N-(2-dodecyloxyethyl) sulfamoyl, N-ethyl-N-dodecylsulfamoyl, and N,N-diethylsulfamoyl), a thiocyanato group, a thiocarbonyl group preferably having 1 to 50 carbon atoms (for example, methylthiocarbonyl and phenylthiocarbonyl), a halogenated alkyl group preferably 1 to 10 carbon atoms (for example, trifluoromethane and heptafluoropropane), a halogenated alkoxy group preferably having 1 to 10 carbon atoms (for example, trifluoromethyloxy), a halogenated aryloxy group (for example, pentafluorophenyloxy), a halogenated alkylamino group (for example, N,N-di-(trifluoromethyl)-amino), a halogenated alkylthio group (for example, difluoromethylthio and 1,1,2,2-tetrafluoroethylthio), an aryl group substituted with the other electron attractive group having $\sigma_p$ of 0.20 or more (for example, 2,4-dinitrophenyl, 2,4,6-trichlorophenyl, and penta-chlorophenyl), a heterocyclic group (for example, 2-benzoxazolyl, 2-benzo-thiazolyl, 1-phenyl-2-benzimidazolyl, 5-chloro-1-tetrazolyl, and 1-pyrrolyl), a halogen atom (for example, a chlorine atom and a bromine atom), an azo group (for example, phenylazo), and a selenocyanato group. Of these substituents, the groups capable of further having the substituents may further have the substituents given for the groups defined for $R_3$.

Preferable substituents represented by $R_1$ and $R_2$ include, an acyl group, an acyloxy group, a carbamoyl group, an alkoxycarbonyl group, an aryloxycarbonyl group, a cyano group, a nitro group, an alkylsulfinyl group, an arylsulfinyl group, an alkyl-sulfonyl group, an arylsulfonyl group, a sulfamoyl group, a halogenated alkyl group, a halogenated alkoxy group, a halogenated alkylthio group, a halogenated aryloxy group, an aryl group substituted with the other electron attractive group having $\sigma_p$ of 0.20 or more, and a heterocyclic group. More preferred are an aryloxycarbonyl group, an alkoxycarbonyl group, a nitro group, a cyano group, an arylsulfonyl group, a carbamoyl group, and a halogenated alkyl group.

Most preferred as $R_1$ is a cyano group. Particularly preferred as $R_2$ is an alkoxycarbonyl group and most preferred is a branched alkoxycarbonyl group.

X represents a hydrogen atom or a group capable of splitting off by the coupling reaction with an oxidation product of an aromatic primary amine color developing agent. More specifically, X may represent a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino group, a 5-membered or 6-membered nitrogen-containing heterocyclic group, an imido group, and an arylazo group. These groups may further be substituted with the groups listed as the substituents for $R_3$.

To be more detailed, X may represent a halogen atom (for example, a fluorine atom, a chlorine atom and a bromine atom), an alkoxy group (for example, ethoxy, dodecyloxy, methoxyethylcarbamoylmethoxy, carboxypropyl-oxy, methylsulfonylethoxy, and ethoxycarbonylmethoxy), an aryloxy group (for example, 4-methylphenoxy, 4-chloro-phenoxy, 4-methoxyphenoxy, 4-carboxyphenoxy, 3-ethoxycarboxyphenoxy, 3-acetylaminophenoxy, and 2-carboxylphenoxy), an acyloxy group (for example, acetoxy, tetradecanoyloxy, and benzoyloxy), an alkyl or arylsulfonyloxy group (for example, methanesulfonyloxy and toluene-sulfonyloxy), an acylamino group (for example, dichloroacetylamino and heptafluorobutylyl-amino), an alkyl or arylsulfonamido group (for example, methanesulfonamido, trifluoromethanesulfonamido, and p-toluenesulfonylamino), an alkoxycarbonyloxy group (for example, ethoxycarbonyloxy and benzyloxycarbonyloxy), an aryloxycarbonyloxy group (for example, phenoxycarbonyl-oxy), an alkyl, aryl or heterocyclic thio group (for example, dodecylthio, 1-carboxydodecylthio, phenylthio, 2-butoxy-5-t-octylphenylthio, and tetrazolylthio), a carbamoylamino group (for example, N-methylcarbamoyl-amino and N-phenylcarbamoylamino), a 5-membered or 6-membered nitrogen-containing heterocyclic group (for example, imidazolyl, pyrazolyl, triazolyl, tetrazolyl, and 1,2-dihydro-2-oxo-1-pyridyl), an imido group (for example, succinimido and hydantoinyl), and an arylazo group (for example, phenylazo and 4-methoxyphenylazo). In addition to the above groups, X may be of the form of a splitting group having a bond via a carbon atom in a bis type coupler in some cases, which can be obtained by condensing a tetraequivalent coupler with aldehydes or ketones. Further, X may contain a photographically useful group such as a development inhibitor and a development accelerator.

X is preferably a halogen atom, an alkoxy group, an aryloxy group, an alkyl or arylthio group, or a 5-membered or 6-membered nitrogen-containing heterocyclic group bonded to a coupling active site via the nitrogen atom. X is more preferably a halogen atom, or an alkyl or arylthio group. Particularly preferred is an arylthio group.

In order to incorporate the cyan coupler of the present invention into a silver halide light-sensitive material, preferably a red-sensitive silver halide emulsion layer, the cyan coupler is preferably converted to a coupler-in-emulsion type coupler. For meeting this purpose, at least one of the groups represented by $R_1$, $R_2$, $R_3$ and X is preferably a so-called ballast group (preferably having 10 or more total carbon atoms, more preferably 10 to 50 total carbon atoms). In particular, $R_3$ is preferably the ballast group.

In the present invention, the cyan coupler represented by formula (I), particularly the cyan coupler represented by formula (I-a), is preferred in terms of the effect thereof.

Examples of the cyan couplers of the present invention are shown below but the present invention is not limited thereto.

C-1

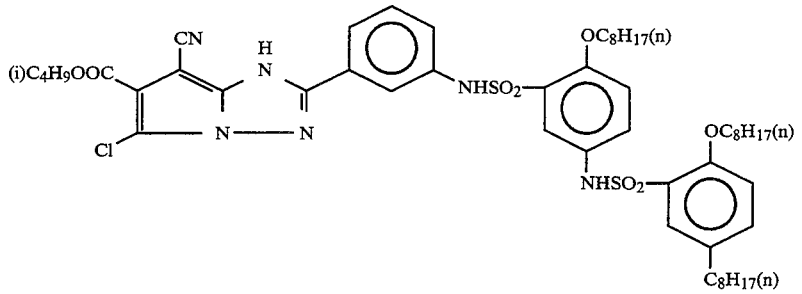

C-2

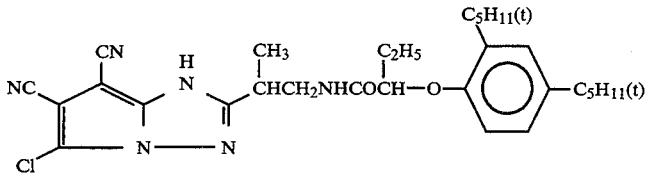

-continued
C-3
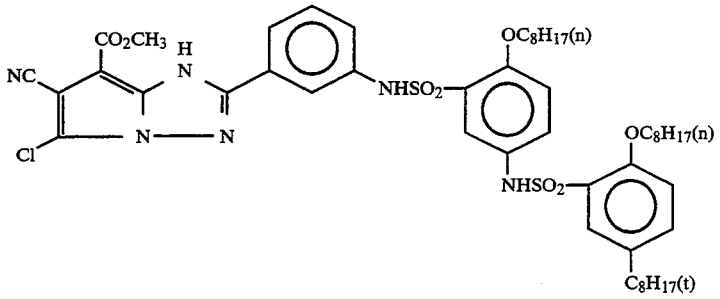
C-4
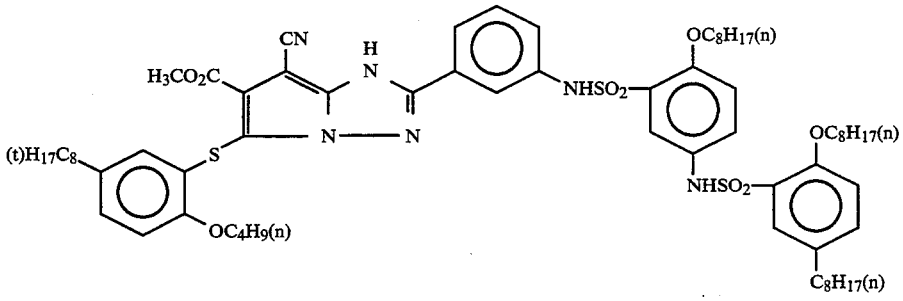
C-5
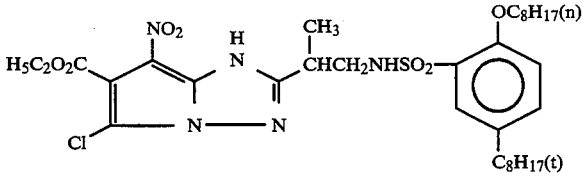
C-6
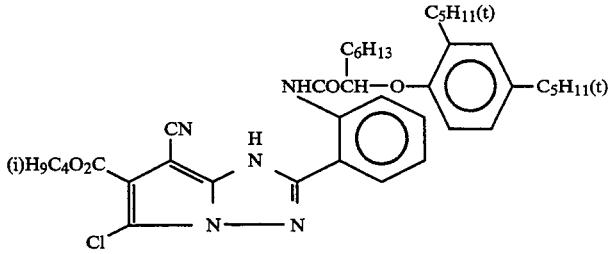
C-7
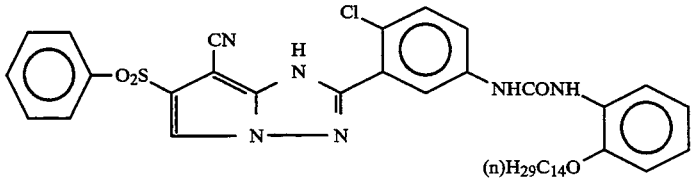
C-8
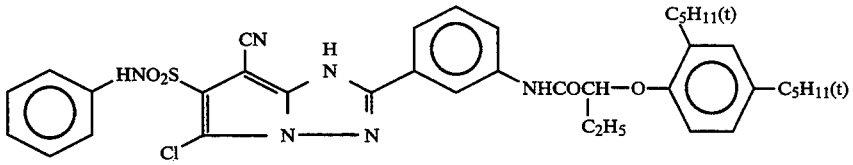

-continued
C-9
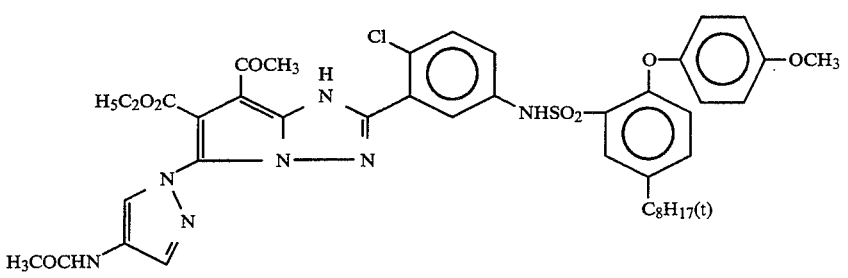
C-10
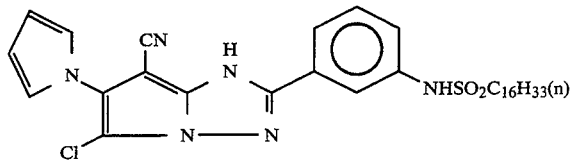
C-11
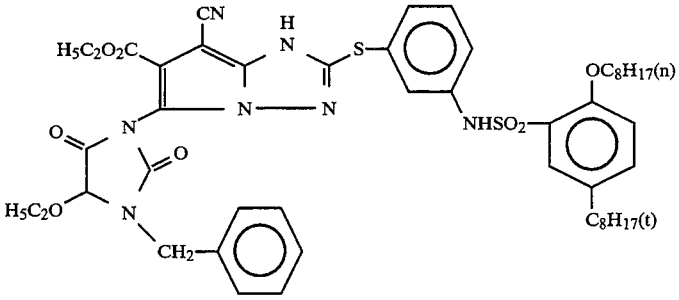
C-12
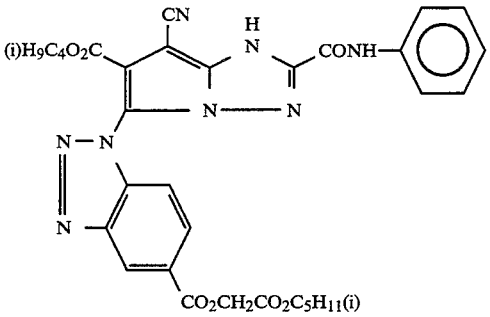
C-13
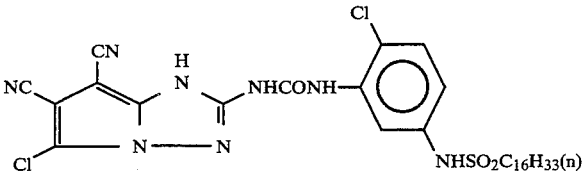
C-14
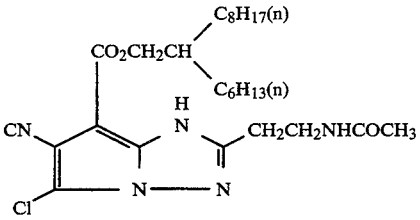

-continued
C-15
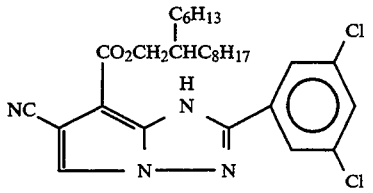
C-16
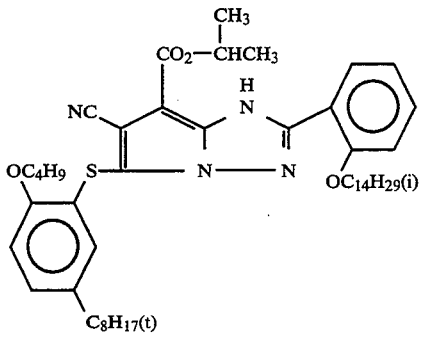
C-17
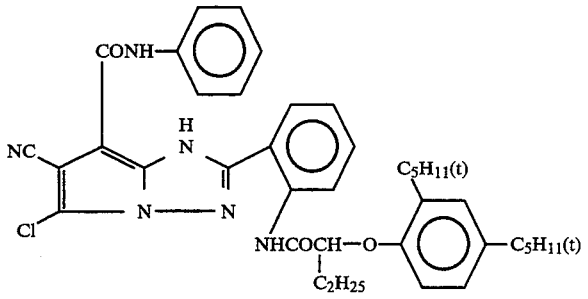
C-18
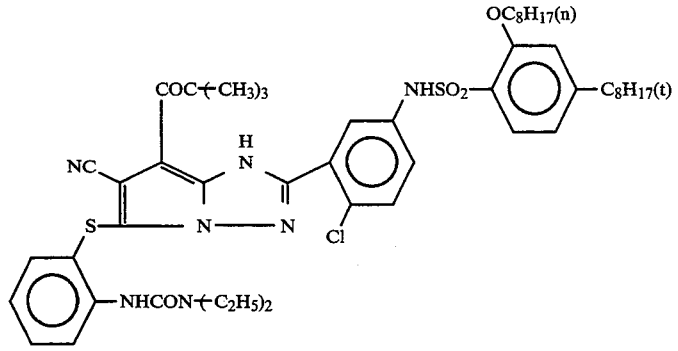
C-19
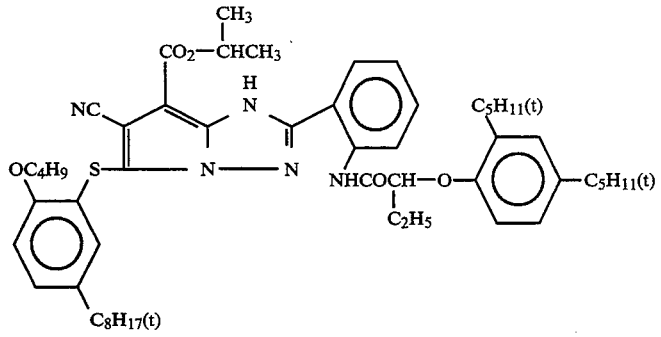

-continued
C-20
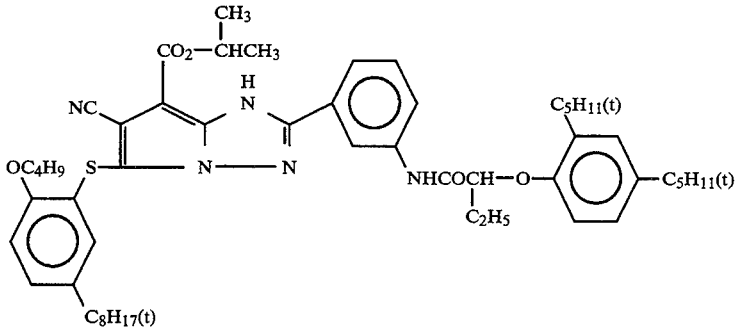
C-21
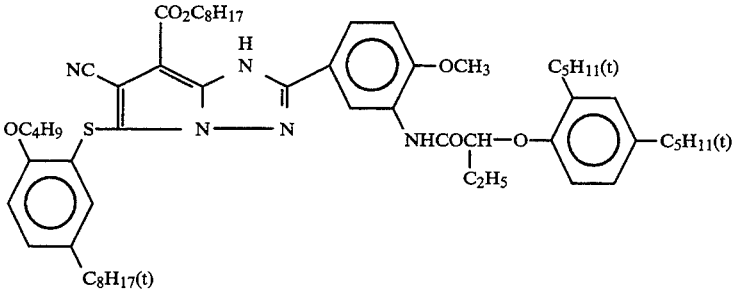
C-22
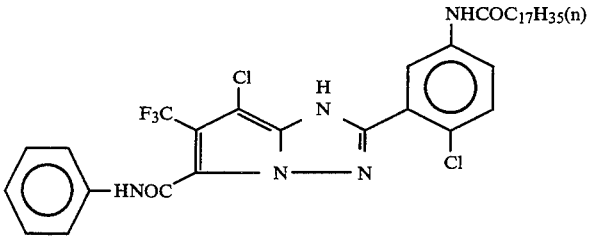
C-23
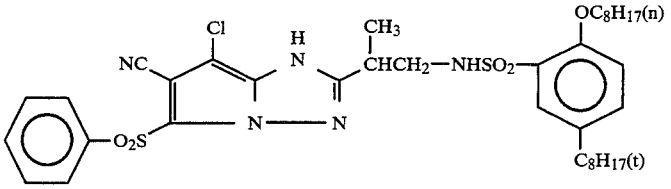
C-24
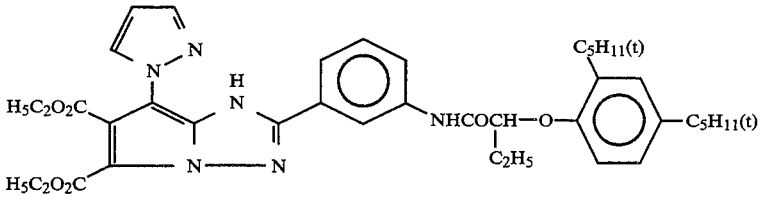
C-25
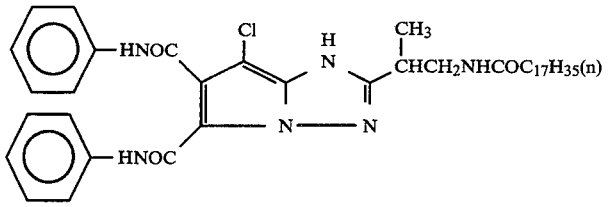

-continued
C-26
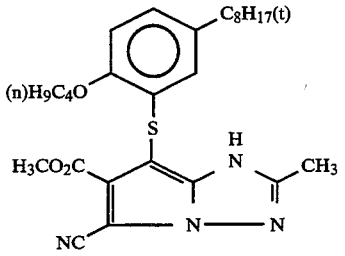
C-27
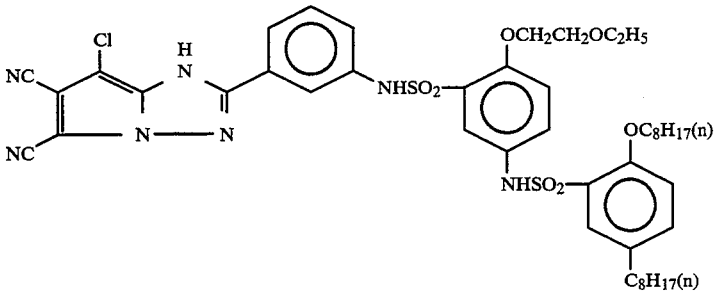
C-28
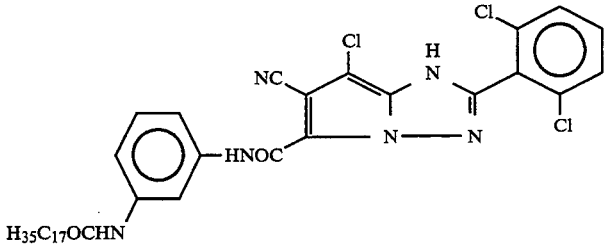
C-29
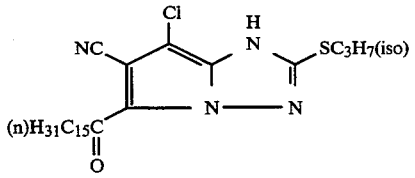
C-30
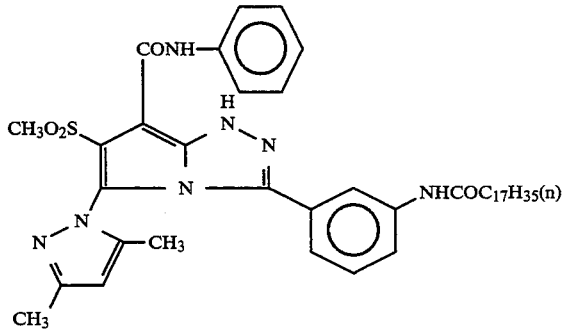
C-31
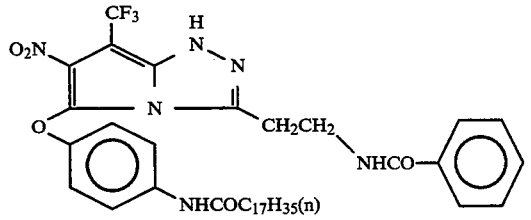

-continued
C-32
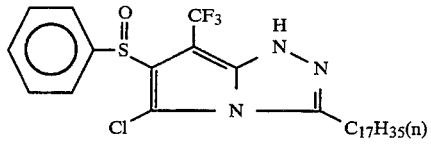
C-33
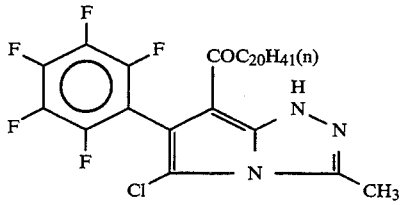
C-34
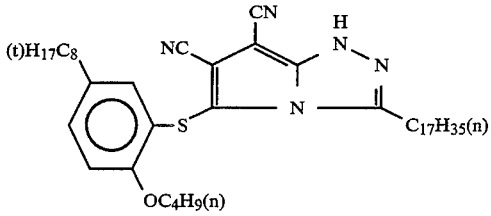
C-35
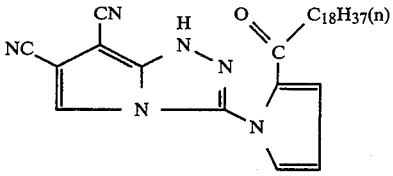
C-36
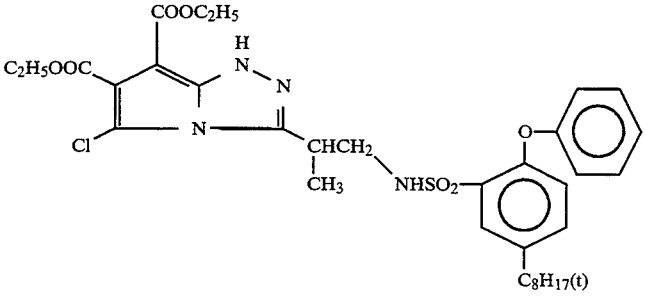
C-37
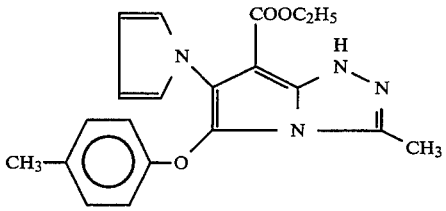
C-38
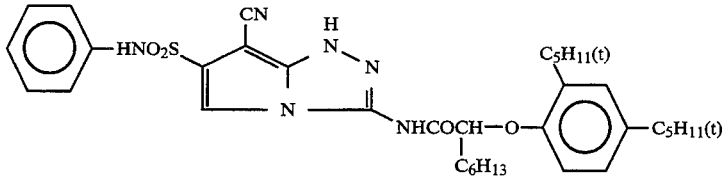

-continued
C-39
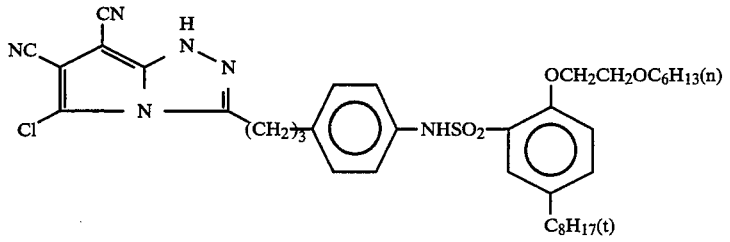
C-40
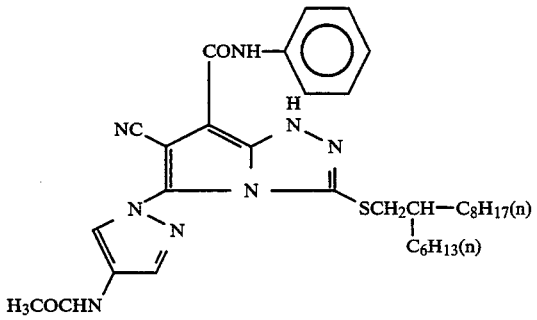
C-41
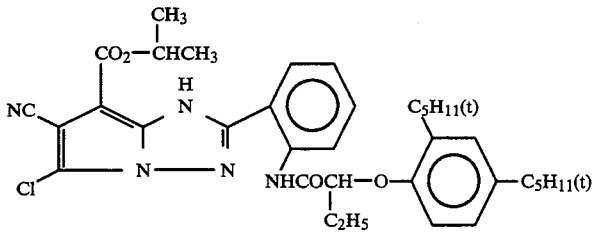
C-42
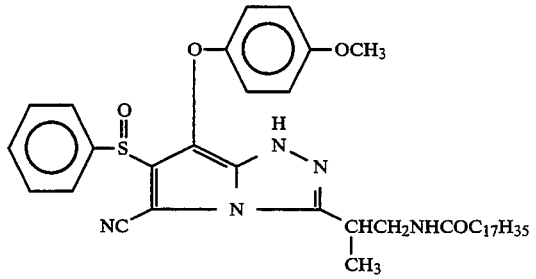
C-43
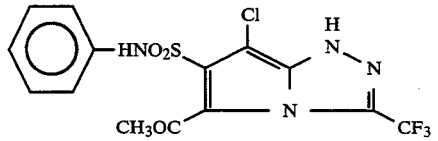
C-44
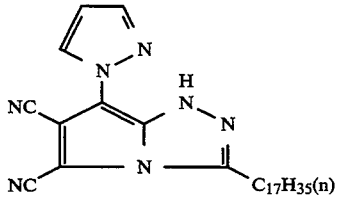

-continued
C-45
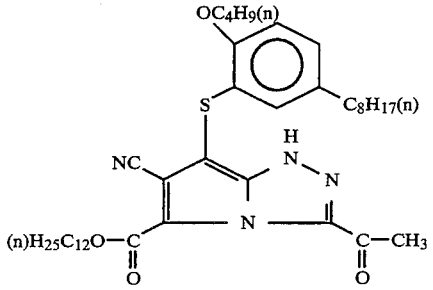
C-46
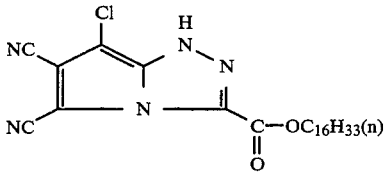
C-47
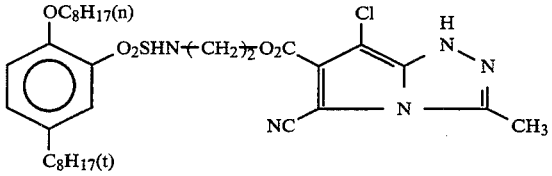
C-48
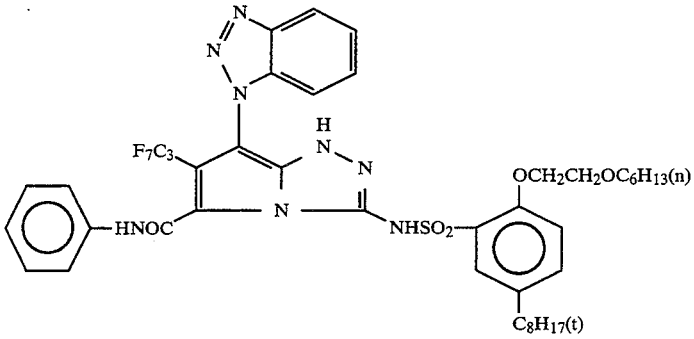
C-49
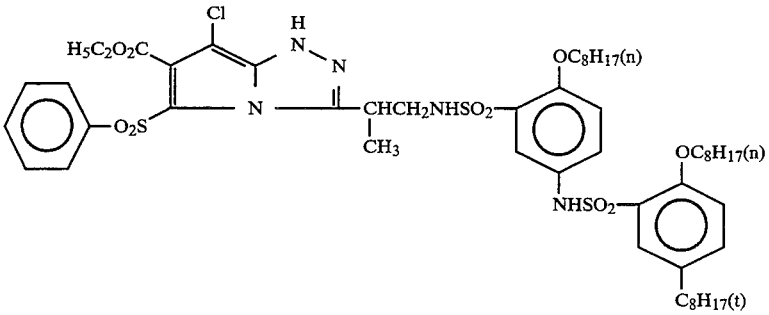
C-50
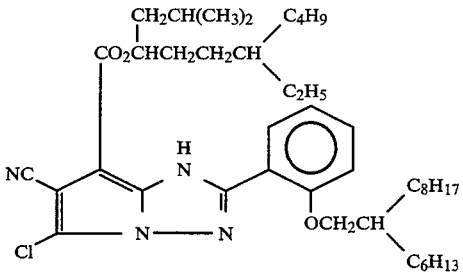

-continued
C-51
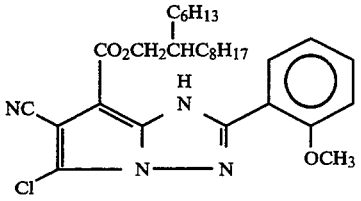
C-52
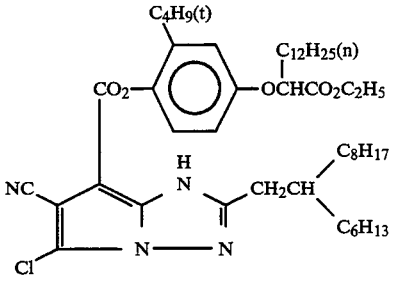
C-53
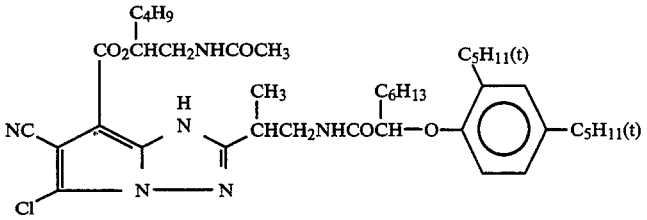
C-54
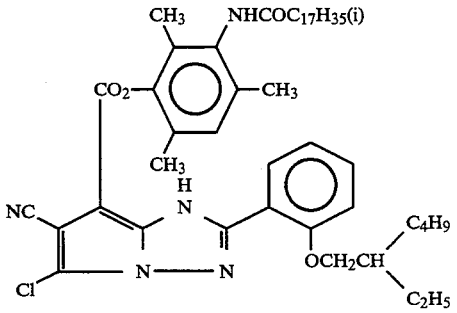
C-55
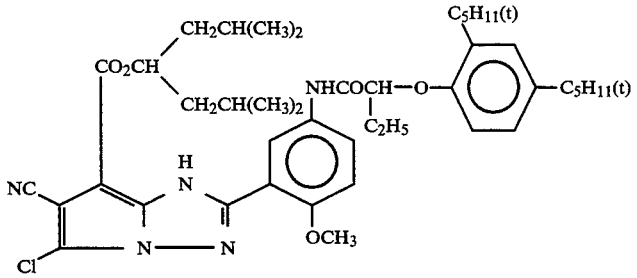
C-56
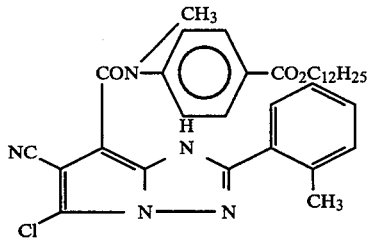

-continued
C-57
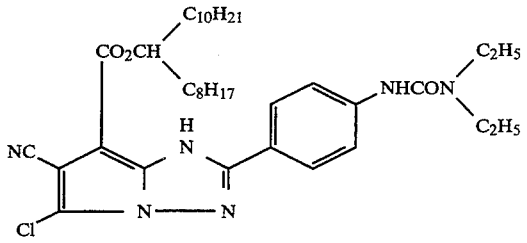
C-58
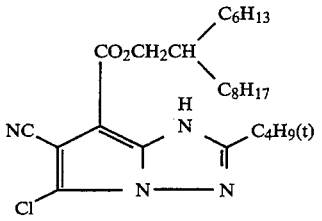
C-59
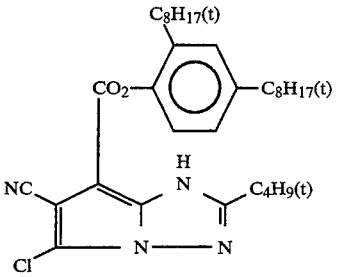
Examples of the synthesis of the cyan couplers of the present invention are shown below in order to explain the synthetic method thereof.
Synthetic Example 1 [synthesis of Exemplified Compound C-1]
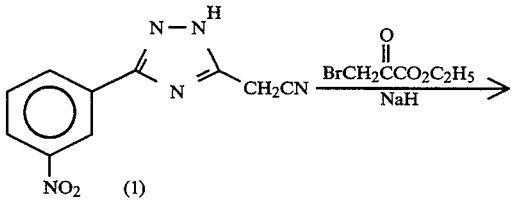
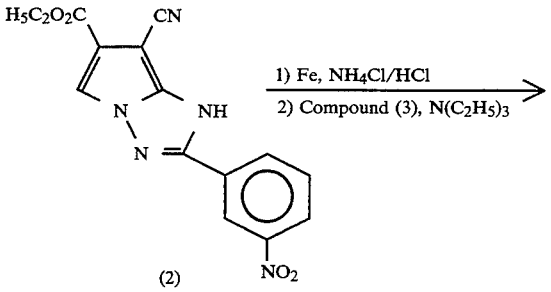
-continued
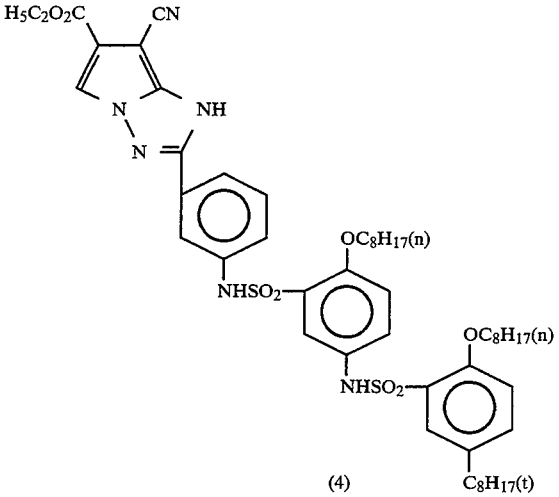
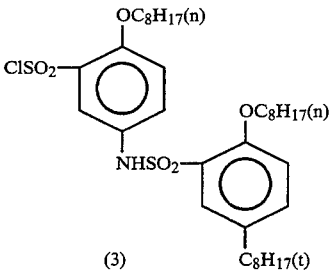

-continued

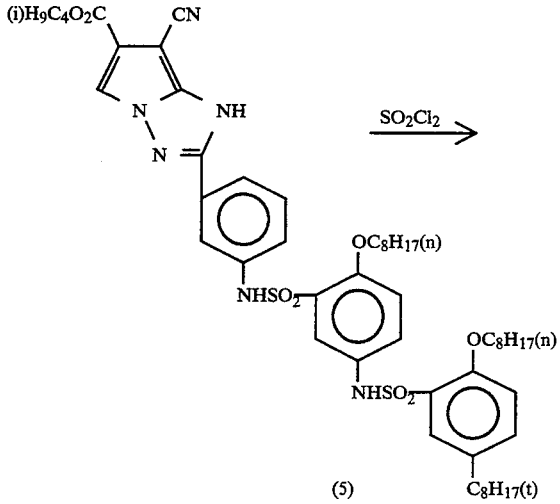

(5)

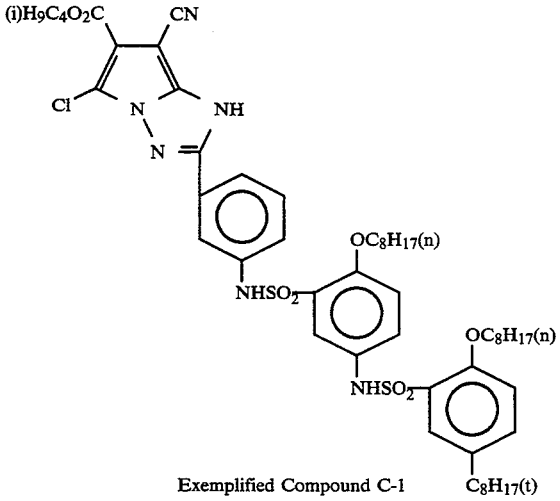

Exemplified Compound C-1

3-m-Nitrophenyl-5-methylcyano-1,2,4-triazole (1) (20.0 g, 87.3 mmol) was dissolved in dimethylacetamide (150 ml), and NaH (60% in oil) (7.3 g, 183 mmol) was added thereto in small increments, followed by heating to 80° C. The dimethylacetamide solution (50 ml) of ethyl bromopyruvate (13.1 ml, 105 mmol) was added drop by drop to the above solution. It was stirred at 80° C. for 30 minutes after the addition of the ethyl bromopyruvate and then was cooled down to room temperature. Hydrochloric acid (1N) was added to the reaction solution to make it acid, and then the solution was extracted with ethyl acetate. After drying on sodium sulfate, the solvent was distilled off under a reduced pressure. The residue was refined with a silica gel chromatography to obtain the compound (2) (10.79 g, 38%).

Reduced iron (9.26 g, 166 mmol) and ammonium chloride (0.89 g, 16.6 mmol) were suspended in isopropanol 300 ml and then, water 30 ml and conc. Hydrochloric acid 2 ml were further added to heat and reflux the suspension for 30 minutes. The compound (2) (10.79 g, 33.2 mmol) was added thereto in small increments while heating and refluxing. After heating and refluxing for an additional 4 hours, the solution was immediately filtered with celite and the filtrate was subjected to a distillation under a reduced pressure. The residue was dissolved in the mixed solvent of dimethylacetamide 40 ml and ethyl acetate 60 ml and the compound (3) (25.6 g, 36.5 mmol) was added thereto. Then, triethylamine (23.1 ml, 166 mmol) was added and the solution was heated at 70° C. for 5 hours. After the reaction solution was cooled down to room temperature, water was added thereto and the solution was extracted with ethyl acetate. After the extract was washed with water, it was dried on sodium sulfate and the solvent was distilled off under a reduced pressure. The residue was refined with a silica gel chromatography to obtain compound (4) (16.5 g, 52%).

Compound (4) (7.0 g, 7.30 mmol) was dissolved in isobutanol (14 ml) and tetraisopropyl orthotitanate (0.43 ml, 1.46 mmol) was added, followed by heating for refluxing for 6 hours. After the reaction solution was cooled down to room temperature, water was added thereto and the solution was extracted with ethyl acetate. The extract was dried on sodium sulfate and the solvent was distilled off under a reduced pressure. The residue was refined with a silica gel chromatography to obtain the compound (5) 5.0 g (69%).

Compound (5) (5.0 g, 5.04 mmol) was dissolved in tetrahydrofuran (50 ml), and $SO_2Cl_2$ (0.40 ml, 5.04 mmol) was added drop by drop while cooling with water. The solution was then stirred for an additional 4 hours while cooling with water. Water was added to the reaction solution and the solution was extracted with ethyl acetate. The extract was dried on sodium sulfate and the solvent was distilled off under a reduced pressure. The residue was refined through silica gel chromatography to obtain the exemplified compound C-1 (3.9 g, 76%).

Synthetic Example 2 [synthesis of Exemplified Compound C-39]

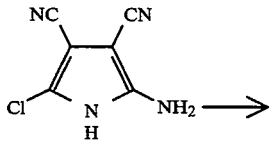

(6)

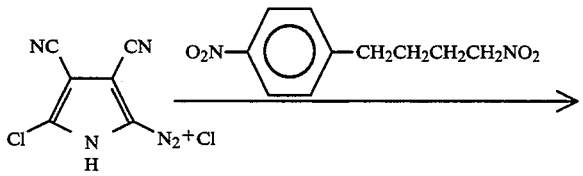

(7)

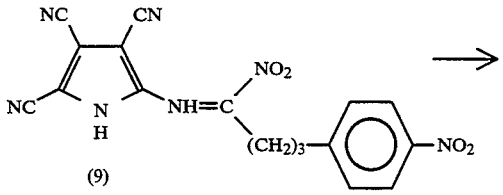

(9)

-continued

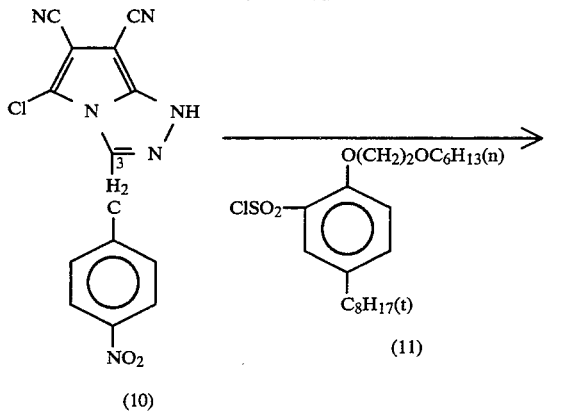

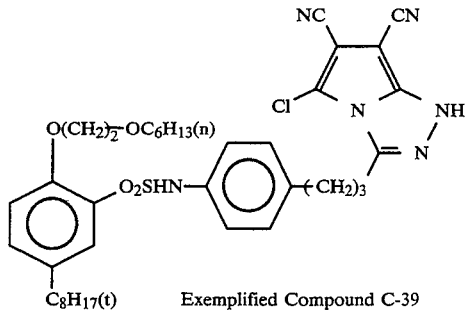

Exemplified Compound C-39

Hydrochloric acid (36%) 38 ml was added to 2-amino-5-chloro-3,4-dicyanopyrrole (6) (6.78 g, 40.7 mmol), and the aqueous solution 5.9 ml of sodium nitrite (2.95 g, 42.7 mmol) was slowly added drop by drop while stirring and cooling with ice, followed by continuing stirring for further 1.5 hours, whereby the compound (7) was prepared. While stirring and cooling with ice, the solution of the compound (7) thus prepared was slowly added drop by drop to a solution prepared by adding sodium methylate (28%) 102 ml to the ethanol solution 177 ml of the compound (8) (9.58 g, 427 mmol) while stirring and cooling with ice, and then stirring was continued for 1 hour. Next, the reaction solution was heated for refluxing for 1.5 hours. Then, ethanol was distilled off from the reaction solution under a reduced pressure, and the residue was dissolved in chloroform. The solution thus prepared was washed with a saturated brine, and after drying on sodium sulfate, chloroform was distilled off under a reduced pressure. The residue was refined through silica gel chromatography to obtain compound (10) 4.19 g [the yield from compounds (6) through (10): 29%).

Compound (6) was synthesized by subjecting 3,4-dicyanopyrrole to nitration and reduction with iron after chlorination. Also, compound (8) was synthesized from compound (a) synthesized from γ-lactone and benzene according to the method described in *Journal of the American Chemical Society*, 76, pp. 3209 (1954).

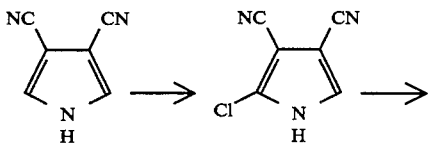

-continued

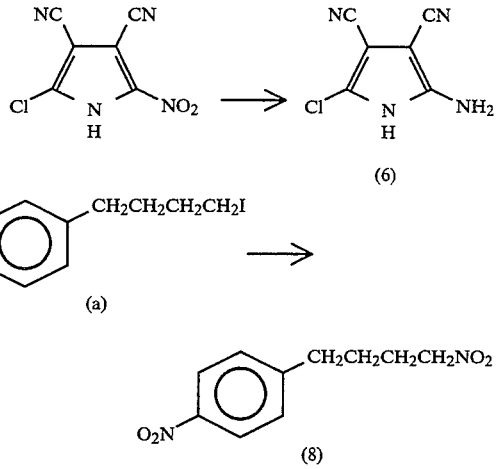

Water (10 ml), ammonium chloride (0.3 g, 5.9 mmol) and acetic acid (0.34 ml, 5.9 mmol) were added to reduced iron powder (3.3 g, 59.0 mmol), and the solution thus prepared was heated for refluxing for 15 minutes while stirring. Then, isopropanol (31 ml) was added thereto and the solution was heated for refluxing for further 20 minutes while stirring. Next, the isopropanol solution 14 ml of compound (10) (4.1 g, 11.8 mmol) was dropped and the solution was heated for refluxing for 2 hours. Then, the reaction solution was filtered using celite as a filter aid and the residue was washed with ethyl acetate, followed by distilling the solution under a reduced pressure.

The residue was dissolved in a mixed solvent of ethyl acetate (16 ml) and dimethylacetamide (24 ml). Added thereto was compound (11) (5.6 g, 13.0 mmol) and further triethylamine (8.2 ml, 59.0 mmol), and the solution was stirred at room temperature for 4 hours. Water was added thereto and the solution was extracted with ethyl acetate, followed by washing the extract with a saturated brine. After drying on sodium sulfate, the solvent was distilled off under a reduced pressure and the residue was refined with a silica gel chromatography, whereby exemplified compound C-39 (6.46 g, 76%) could be obtained.

The other couplers of the present invention can be synthesized in a similar manner.

The amount of cyan coupler of the present invention in a light-sensitive material is suitable $1\times10^{-3}$ mole to 1 mole, preferably $2\times10^{-3}$ mole to $3\times10^{-1}$ mole per mole of silver halide.

Next, the sparingly water-soluble homopolymer and/or copolymer will be explained.

The polymers used in the present invention may be anyone as long as they are sparingly water-soluble and organic solvent-soluble. Preferred in terms of the effects of the improvement in color-forming property and color fading are the sparingly water-soluble and organic solvent-soluble noncolor-forming polymers having a repeating unit containing an acid group at least on a main chain or a side chain, and the amount of the repeating unit is 20 mole % or less to the overall repeating units. Among them, more preferred are the polymers having a repeating unit having a >C=O bond, and further more preferred are the polymers having a —C(=O)O— bond or a —C(=O)NHR group (in which R represents a substituted or unsubstituted alkyl or aryl group having a total carbon number of 3 to 12, e.g., benzyl, cyanoethyl, ethoxyethyl, ethoxypropyl and 1H,1H,5H-octafluoropentyl).

Further, preferred as a monomer for the polymer of the present invention, are monomers the homopolymers of which (the molecular weight of 20,000 or more) have a glass transition point (Tg) of 50° C. or higher. More preferred is a polymer having a Tg of 80° C. or higher. That is, where the polymers constituted by the monomers the homopolymers of which have Tg of 50° C. or lower are used, an image fastness improving effect is certainly observed under a forced condition at a high temperature (80° C. or higher), but the effect is reduced as room temperature is approached, and the dye fastness gets close to that of the light-sensitive material into which no polymer is incorporated. Meanwhile, where the copolymers constituted by monomers the homopolymers of which have Tg of 50° C. or higher are used, the improving effect becomes equivalent to or more than that under a forced condition at a high temperature (80° C. or higher) as room temperature is approached. In particular, where the polymers constituted by the monomers the homopolymers of which have Tg of 80° C. or higher are used, the improving effect is markedly increased as room temperature is approached. This tendency is notable when the acrylamide type and methacrylamide type polymers are used, and therefore is preferred very much.

Further, polymers having a larger heat fastness improving effect have a tendency to have a larger improving effect to light fastness. In particular, the improving effect was notable at a low density portion such as reflecting density of 0.2to 0.5.

Where the polymers of the present invention have a repeating unit having an acid group, the content of the acid group is 20 mole % or less, preferably 10 mole % or less. The lower limit of the content of the acid group is 0 mole %.

In the present invention, a homopolymer is preferable.

Preferred as a sparingly water-soluble polymer are the loadable latex polymers described in U.S. Pat. No. 4,203,716, and the sparingly water-soluble and organic solvent-soluble polymers described in International Patent (PCT) Application W088/00723A. The latter type polymers are preferred.

There can be given as the examples of the sparingly water-soluble polymer, a vinyl polymer (a methacrylate type, an acrylamide type, and a methacrylamide type polymer), a polyester resin obtained by condensing a polyhydric alcohol with a polybasic acid, a polyurethane resin obtained by condensing glycol or divalent phenol with a carbonic ester or phosgene, and a polyester resin obtained by a ring-opening polymerization. These polymers may be used in arbitrary combination of two or more kinds.

The dispersion in which there coexist at least one of the cyan couplers of the present invention and at least one of the sparingly water-soluble homopolymers or copolymers can be synthesized in the following manner. That is, where the polymer is a loadable latex, the dispersion can be obtained by impregnating the cyan coupler into the polymer (the preparation method thereof is described in detail in U.S. Pat. No. 4,203,716). The polymer is preferably organic solvent-soluble, and in this case, the dispersion can be obtained by dissolving the cyan coupler and organic solvent-soluble polymer in an organic solvent, and emulsifying and dispersing this solution in a hydrophilic binder such as a gelatin solution (using a surface active agent according to necessity) by a dispersing means such as a stirrer, a homogenizer, a colloid mill, a flow jet mixer, and supersonic equipment (the details thereof are described in U.S. Pat. No. 4,857,449 and International Application WO88/00723A).

Further, the dispersion may be obtained by dispersing polymers prepared by suspension polymerization, solution polymerization or block polymerization of the monomer components of the above polymers in the presence of photographically useful substances, such as a coupler, in a hydrophilic binder in a similar manner (a detailed method thereof is described in JP-A-60-107642).

The above dispersion may contain a high boiling solvent. There can be used as the high boiling solvent, organic solvents having a boiling point of 150° C. or higher, such as a phenol derivative, phthalic acid ester, phosphoric acid ester, citric acid ester, benzoic acid ester, alkylamide, aliphatic ester, and trimesic acid ester, which do not react with an oxidation product of a developing agent.

The following auxiliary solvents (a low boiling and water-soluble solvent) are preferably used for dissolving the polymers and couplers used in the present invention.

There can be given as the low boiling solvent, ethyl acetate, butyl acetate, ethyl propionate, secondary butyl alcohol, methyl ethyl ketone, methyl isobutyl ketone, β-ethoxyethyl acetate, methylcellosolve acetate, and cyclohexanone.

Further, there can be given as the water-soluble solvent, methyl alcohol, ethyl alcohol, acetone, and tetrahydrofuran. These solvents can be used in combination of two or more kinds according to necessity.

The grain size of an emulsion containing the sparingly water-soluble polymer is not specifically limited. It is preferably 0.04 to 2 μm, more preferably 0.06 to 0.4 μm. This grain size can be measured with measuring equipment such as a Nanosizer, manufactured by Coal Tar Co., Ltd., United Kingdom.

The weight-average molecular weight of the polymers capable of being used in the present invention is generally 300,000 or less, preferably 55,000 or less, and more preferably 30,000 or less. The lower limit of the weight-average molecular weight is 1,000, preferably 5,000 and more preferably 20,000. The lower weight-average molecular weight of the polymer makes the maximum color development density higher, and makes the amount of an auxiliary solvent to be used for dissolution fewer.

The ratio of the polymer of the present invention to an auxiliary solvent is preferably about 1:1 to 1:50 (weight ratio). The ratio (weight ratio) of the polymer of the present invention to a cyan coupler represented by the formula (I) or (II) is preferably 1:20 to 20:1, more preferably 1:10 to 10:1.

Specific examples of the polymers used in the present invention are shown below, but the present invention is not limited thereto. The ratio in a copolymer is expressed in terms of a mole ratio.

| Example | Kind of polymer |
|---|---|
| P-1) | Polyvinyl acetate |
| P-2) | Polyvinyl propionate |
| P-3) | Polymethyl methacrylate |
| P-4) | Polyethyl methacrylate |

-continued

| Example | Kind of polymer |
|---|---|
| P-5) | Polyethyl acrylate |
| P-6) | Copolymer of vinyl acetate and vinylalcohol (95:5) |
| P-7) | Poly-n-butyl acrylate |
| P-8) | Poly-n-butyl methacrylate |
| P-9) | Polyisobutyl methacrylate |
| P-10) | Polyisopropyl methacrylate |
| P-11) | Polydecyl methacrylate |
| P-12) | Coplymer of n-butyl acrylate and acrylamide (95:5) |
| P-13) | Polymethyl chloracrylate |
| P-14) | Polyester from 1,4-butanediol and adipic acid |
| P-15) | Polyester from ethylene glycol and sebacic acid |
| P-16) | Polycaprolactone |
| P-17) | Poly (2-tert-butylphenyl acrylate) |
| P-18) | Poly (4-tert-butylphenyl acrylate) |
| P-19) | Copolymer of n-butyl methacrylate and N-vinyl-2-pyrrolidone (90:10) |
| P-20) | Copolymer of methyl methacrylate and vinyl chloride (70:30) |
| P-21) | Copolymer of methyl methacrylate and styrene (90:10) |
| P-22) | Copolymer of methyl methacrylate and ethyl acrylate (50:50) |
| P-23) | Copolymer of n-butyl methacrylate, methyl methacrylate and styrene (50:30:20) |
| P-24) | Copolymer of vinyl acetate and acrylamide (85:15) |
| P-25) | Copolymer of vinyl chloride and vinyl acetate (65:35) |
| P-26) | Copolymer of methyl methacrylate and acrylonitrile (65:35) |
| P-27) | Copolymer of diacetone acrylamide and methyl methacrylate (50:50) |
| P-28) | Copolymer of vinyl methyl ketone and isobutyl methacrylate (55:45) |
| P-29) | Copolymer of ethyl methacrylate and n-butyl acrylate (70:30) |
| P-30) | Copolymer of diacetone acrylamide and n-butyl acrylate (60:40) |
| P-31) | Copolymer of methyl methacrylate and cyclohexyl methacrylate (50:50) |
| P-32) | Copolymer of n-butyl acrylate, styrene methacrylate and diacetone acrylamide (70:20:10) |
| P-33) | Copolymer of N-tert-butyl metacrylamide, methyl methacrylate and acrylic acid (60:30:10) |
| P-34) | Copolymer of methtyl methacrylate, styrene and vinyl sulfonamide (70:20:10) |
| P-35) | Copolymer of methyl methacrylate and phenylvinyl ketone (70:30) |
| P-36) | Copolymer of n-butyl acrylate, methyl methacrylate and n-butyl metacrylamide (35:35:30) |
| P-37) | Copolymer of n-butyl methacrylate, pentyl methacrylate and N-vinyl-2-pyrrolidone (38:38:24) |
| P-38) | Copolymer of methyl methacrylate, n-butyl methacrylate, isobutyl methacrylate and acrylic acid (37:29:25:9) |
| P-39) | Copolymer of n-butyl methacrylate and acrylic acid (95:5) |
| P-40) | Copolymer of methyl methacrylate and acrylic acid (95:5) |
| P-41) | Copolymer of benzyl methacrylate and acrylic acid (90:10) |
| P-42) | Copolymer of n-butyl methacrylate, methyl methacrylate, benzyl methacrylate and acrylic acid (35:35:25:5) |
| P-43) | Copolymer of n-butyl methacrylamide, methyl methacrylate and benzyl methacrylate (35:35:30) |
| P-44) | Poly-3-pentyl acrylate |
| P-45) | Copolymer of cyclohexyl methacrylate, methyl methacrylate and n-propyl methacrylate (37:29:34) |
| P-46) | Polypentyl methacrylate |
| P-47) | Copolymer of methyl methacrylate and n-butyl methacrylate (65:35) |
| P-48) | Copolymer of vinyl acetate and vinyl propionate (75:25) |
| P-49) | Copolymer of n-butyl methacrylate and sodium 3-acryloxybutane-l-sulfonate (97:3) |
| P-50) | Copolymer of n-butyl methacrylate, methyl methacrylate and acrylamide (35:35:30) |
| P-51) | Copolymer of n-butyl methacrylate, methyl methacrylate and vinyl chloride (37:36:27) |
| P-52) | Copolymer of n-butyl methacrylate and styrene (90:10) |
| P-53) | Copolymer of methyl methacrylate and N-vinyl-2-pyrrolidone (90:10) |
| P-54) | Copolymer of n-butyl methacrylate and vinyl chloride (90:10) |
| P-55) | Copolymer of n-butyl methacrylate and styrene (70:30) |
| P-56) | Poly (N-sec-butylacrylamide) |
| P-57) | Poly (N-tert-butylacrylamide) |
| P-58) | Copolymer of diacetone acrylamide and methyl methacrylate (62:38) |
| P-59) | Copolymer of cyclohexyl methacrylate and methyl methacrylate (60:40) |
| P-60) | Copolymer of N-tert-butylacrylamide and methyl methacrylate (40:60) |
| P-61) | Poly (N-n-butylacrylamide) |
| P-62) | Copolymer of tert-butyl methacrylate and N-tert-butylacrylamide (50:50) |
| P-63) | Copolymer of tert-butyl methacrylate and methyl methacrylate (70:30) |
| P-64) | Poly (N-tert-butylmetacrylamide) |
| P-65) | Copolymer of N-tert-butylacrylamide and methyl methacrylate (60:40) |
| P-66) | Copolymer of methyl methacrylate and acrylonitrile (70:30) |
| P-67) | Copolymer of methyl methacrylate and vinyl methyl ketone (38:62) |
| P-68) | Copolymer of methyl methacrylate and styrene (75:25) |
| P-69) | Copolymer of methyl methacrylate and hexyl methacrylate (70:30) |
| P-70) | Poly (benzyl acrylate) |
| P-71) | Poly (4-biphenyl acrylate) |
| P-72) | Poly (4-butoxycarbonylphenyl acrylate) |
| P-73) | Poly (sec-butyl acrylate) |
| P-74) | Poly (tert-butyl acrylate) |
| P-75) | Poly (3-chloro-2,2-bis(chloromethyl) propyl acrylate) |
| P-76) | Poly (2-chlorophenyl acrylate) |
| P-77) | Poly (4-chlorophenyl acrylate) |
| P-78) | Poly (pentachlorophenyl acrylate) |
| P-79) | Poly (4-cyanobenzyl acrylate) |
| P-80) | Poly (cyanoethyl acrylate) |
| P-81) | Poly (4-cyanophenyl acrylate) |
| P-82) | Poly (4-cyano-3-thiabutyl acrylate) |
| P-83) | Poly (cyclohexyl acrylate) |
| P-84) | Poly (2-ethoxycarbonylphenyl acrylate) |
| P-85) | Poly (3-ethoxycarbonylphenyl acrylate) |
| P-86) | Poly (4-ethoxycarbonylphenyl acrylate) |
| P-87) | Poly (2-ethoxyethyl acrylate) |
| P-88) | Poly (3-ethoxypropyl acrylate) |
| P-89) | Poly (1H, 1H, 5H-octafluoropentyl acrylate) |
| P-90) | Poly (heptyl acrylate) |
| P-91) | Poly (hexadecyl acrylate) |
| P-92) | Poly (hexyl acrylate) |
| P-93) | Poly (isobutyl acrylate) |
| P-94) | Poly (isopropyl acrylate) |
| P-95) | Poly (3-methoxybutyl acrylate) |
| P-96) | Poly (2-methoxycarbonylphenyl acrylate) |
| P-97) | Poly (3-methoxycarbonylphenyl acrylate) |
| P-98) | Poly (4-methoxycarbonylphenyl acrylate) |
| P-99) | Poly (2-methoxyethyl acrylate) |
| P-100) | Poly (4-methoxyphenyl acrylate) |
| P-101) | Poly (3-methoxypropyl acrylate) |
| P-102) | Poly (3,5-dimethyladamantyl acrylate) |
| P-103) | Poly (3-dimethylaminophenyl acrylate) |
| P-104) | Polyvinyl-tert-butylate |
| P-105) | Poly (2-methylbutyl acrylate) |
| P-106) | Poly (3-methylbutyl acrylate) |
| P-107) | Poly (1,3-dimethylbutyl acrylate) |
| P-108) | Poly (2-methylpentyl acrylate) |
| P-109) | Poly (2-naphthyl acrylate) |
| P-110) | Poly (phenyl acrylate) |

-continued

| Example | Kind of polymer |
|---|---|
| P-111) | Poly (propyl acrylate) |
| P-112) | Poly (m-tolyl acrylate) |
| P-113) | Poly (o-tolyl acrylate) |
| P-114) | Poly (p-tolyl acrylate) |
| P-115) | Poly (N,N-dibutylacrylamide) |
| P-116) | Poly (isohexylacrylamide) |
| P-117) | Poly (isooctylacrylamide) |
| P-118) | Poly (N-methyl-N-phenylacrylamide) |
| P-119) | Poly (adamantyl methacrylate) |
| P-120) | Poly (benzyl methacrylate) |
| P-121) | Poly (2-bromoethyl methacrylate) |
| P-122) | Poly (2-N-tert-butylaminoethyl methacrylate) |
| P-123) | Poly (sec-butyl methacrylate) |
| P-124) | Poly (tert-butyl methacrylate) |
| P-125) | Poly (2-chloroethyl methacrylate) |
| P-126) | Poly (2-cyanoethyl methacrylate) |
| P-127) | Poly (2-cyanomethylphenyl methacrylate) |
| P-128) | Poly (4-cyanophenyl methacrylate) |
| P-129) | Poly (cyclohexyl methacrylate) |
| P-130) | Poly (dodecyl methacrylate) |
| P-131) | Poly (diethylaminoethyl methacrylate) |
| P-132) | Poly (2-ethylsulfinylethyl methacrylate) |
| P-133) | Poly (hexadecyl methacrylate) |
| P-134) | Poly (hexyl methacrylate) |
| P-135) | Poly (2-hydroxypropyl methacrylate) |
| P-136) | Poly (4-methoxycarbonylphenyl methacrylate) |
| P-137) | Poly (3,5-dimethyladamantyl methacrylate) |
| P-138) | Poly (dimethylaminoethyl methacrylate) |
| P-139) | Poly (3,3-dimethylbutyl methacrylate) |
| P-140) | Poly (3,3-dimethyl-2-butyl methacrylate) |
| P-141) | Poly (3,5,5-trimethylhexyl methacrylate) |
| P-142) | Poly (octadecyl methacrylate) |
| P-143) | Poly (tetradecyl methacrylate) |
| P-144) | Poly (4-butoxycarbonylphenyl methacrylamide) |
| P-145) | Poly (4-carboxyphenyl methacrylamide) |
| P-146) | Poly (4-ethoxycarbonylphenyl methacrylamide) |
| P-147) | Poly (4-methoxycarbonylphenyl methacrylamide) |
| P-148) | Poly (butylbutoxycarbonyl methacrylate) |
| P-149) | Poly (butyl chloroacrylate) |
| P-150) | Poly (butyl cyanoacrylate) |
| P-151) | Poly (cyclohexyl chloroacrylate) |
| P-152) | Poly (ethyl chloroacrylate) |
| P-153) | Poly (ethyl ethoxycarbonylmethacrylate) |
| P-154) | Poly (ethyl ethacrylate) |
| P-155) | Poly (ethyl fluoromethacrylate) |
| P-156) | Poly (hexyl hexyloxycarbonylmethacrylate) |
| P-157) | Poly (isobutyl chloroacrylate) |
| P-158) | Poly (isopropyl chloroacrylate) |
| P-159) | Poly (p-tert-butylstyrene) |
| P-160) | Copolymer of N-t-butylacrylamide and 2-methoxyethyl acrylate (55:45) |
| P-161) | Copolymer of ω-methoxypolyethylene glycol methacrylate (addition mole number n = 6) and methyl methacrylate (40:60) |
| P-162) | Copolymer of ω-methoxypolyethylene glycol acrylate (addition mole number n = 9) and N-t-butylacrylamide (25:75) |
| P-163) | Poly (2-methoxyethyl methacrylate) |
| P-164) | Poly (2-(2-methoxyethoxy) ethyl acrylate) |
| P-165) | Copolymer of 2-(2-butoxyethoxy) ethyl acrylate and methyl methacrylate (58:42) |
| P-166) | Poly (oxycarbonyloxy-1,4-phenyleneisobutylidene-1,4-phenylene) |
| P-167) | Poly (oxyethyleneoxycarbonyliminohexamethylene-iminocarbonyl) |
| P-168) | Copolymer of N-[4-(4'-hydroxyphenylsufonyl) phenyl] acrylamide and butyl acrylate (65:35) |
| P-169) | Copolymer of N-(4-hydroxyphenyl) methacrylamide and N-t-butylacrylamide (50:50) |
| P-170) | Copolymer of [4-(4'-hydroxyphenylsufonyl) phenoxymethyl] styrene (m, p mixture) and N-t-butylacrylamide (15:85) |
| P-171) | Poly (N,N-dimethylacrylamide) |
| P-172) | Poly (N-t-butylmetacrylamide) |
| P-173) | Polyoctyl acrylate |
| P-174) | Polycaprolactam |
| P-175) | Polypropiolactam |
| P-176) | Polydimethylpropiolactone |
| P-177) | Copolymer of stearyl methacrylate and acrylic acid (90:10) |
| P-178) | Copolymer of stearyl methacrylate, methyl methacrylate and acrylic acid (50:40:10) |
| P-179) | Copolymer of butyl acrylate, styrene methacrylate and diacetone acrylamide (70:20:10) |
| P-180) | Copolymer of N-t-butylacrylamide and methylphenyl methacrylate (60:40) |
| P-181) | Copolymer of N-t-butylmethacrylamide and vinylpyridine (95:5) |
| P-182) | Copolymer of diethyl maleate and butyl acrylate (65:35) |

The sparingly water-soluble polymers according to the present invention can be synthesized by the conventional methods such as those described in U.S. Pat. No. 5,055,386 (corresponding to JP-A-2-6942).

The light-sensitive material of the present invention may have at least one silver halide emulsion layer having a cyan color-forming property. The light-sensitive material of the present invention preferably has at least one silver halide emulsion layer containing a yellow-dye forming coupler, at least one silver halide emulsion layer containing a magenta-dye forming coupler, and at least one silver halide emulsion layer containing a cyan-dye forming coupler, and these emulsion layers are preferably blue-sensitive, green-sensitive and red-sensitive, respectively. The light-sensitive material of the present invention can be of the constitution in which the emulsion layers are provided in this order, but may be of the constitution in which the order is different from this. Also, at least one of the above light-sensitive emulsion layers can be replaced with an infrared-sensitive silver halide emulsion layer.

There can be used as the silver halide used in the present invention, silver chloride, silver bromide, silver (iodo)chlorobromide, and silver iodobromide. In particular, in terms of effectively demonstrating the effects of the present invention and for the purpose of a rapid processing, preferably used is a silver chlorobromide or silver chloride containing substantially no silver iodide and having a silver chloride content of 90 mole % or more, more preferably 95 mole % or more and particularly 98 mole % or more.

For the purpose of improving sharpness of an image, there may be preferably incorporated into a hydrophilic colloid layer of the light-sensitive material according to the present invention, dyes (among them, an oxonol type dye) capable of being decolored by processing so that an optical reflection density of the light-sensitive material at 680 nm becomes 0.70 or more, described at pages 27 to 76 of European Patent Application 0 337 490 A2, and into a water-resistant resin layer of a support, titanium oxide which is subjected to a surface treatment with di- to tetrahydric alcohols (for example, trimethylolethane) in a proportion of 12% by weight or more (more preferably 14% by weight or more).

Also, in the light-sensitive material according to the present invention, color image preservability-improving compounds such as described in European Patent Application 0 227 589 A2 are preferably used together with couplers. In particular, they are used preferably in combination with a pyrazoloazole coupler.

Preferably used for removing side effects of, for example, the generation of stain due to the reaction of a color developing agent or an oxidation product thereof remaining in a layer during storage after processing with couplers are the compounds (A) described in European Patent Application 0 277 589 A2 which chemically combine with an aromatic amine type developing agent remaining after a color development processing to form a chemically inactive and substantially colorless compound, and/or the compound (B) described in European Patent Application 0 277 589 A2 which chemically combine with an oxidation product of an aromatic amine type developing agent remaining after a color development processing to form a chemically inactive and substantially colorless compound.

Further, anti-mold agents such as described in JP-A-63-271247 are preferably added to the light-sensitive material according to the present invention for the purpose of preventing various molds and bacteria which grow in a hydrophilic colloid layer to deteriorate an image.

There may be used as a support for the light-sensitive material according to the present invention for display, a white color polyester type support or a support in which a layer containing a white pigment is provided on a support side having a silver halide emulsion layer. An anti-halation layer is preferably provided on a support side on which a silver halide emulsion layer is coated or the backside thereof in order to further improve a sharpness. In particular, the transmission density of a support is controlled preferably to be 0.35 to 0.8 so that a display can be viewed with either a reflected light or a transmitted light.

The light-sensitive material according to the present invention may be exposed with either a visible ray or an infrared ray. The method of exposure may be either a low illuminance exposure or a high illuminance exposure for a short time. Particularly in the latter case, preferred is a laser scanning exposing method in which an exposing time per a picture element is shorter than $10^{-4}$ second.

During exposure, a band stop filter described in U.S. Pat. No. 4,880,726 is preferably used, whereby a light mixture is removed to notably improve color reproducibility.

Those described in the following patent publications, particularly European Patent Application 0 355 660 A2 (JP-A-2-139544) are preferably used as the silver halide emulsion other materials (the additives) and photographic constitutional layers (a layer arrangement) each applied to the light-sensitive material of the present invention, and the processing methods and additives for processing, which are applied for processing the light-sensitive material:

| Photographic elements | JP-A-62-215272 | JP-A-2-33144 | EP 0 335 660 A2 |
|---|---|---|---|
| Silver halide emulsion | p. 10, right upper col., line 6 to p. 12, left lower col., line 5, and p. 12, right lower col., line 4 from bottom to p. 13, left upper col., line 17. | p. 28, right upper col., line 16 to p. 29, right lower col., line 11, and p. 30, lines 2 to 5 | p. 45, line 53 to p. 47, line 3, and p. 47, lines 20 to 22. |
| Silver halide solvent | p. 12, left lower col., lines 6 to 14, and p. 13, left upper col., line 3 from bottom to p. 18, left lower col., last line. | | |
| Chemical sensitizer | p. 12, left lower col., line 3 from bottom to right lower col., line 5 from bottom, and p. 18, right lower col., line 1 to p. 22, right upper col., line 9 from bottom. | p. 29, right lower col., line 12 to last line. | p. 47, lines 4 to 9. |
| Spectral sensitizer (spectral sensitizing method) | p. 22, right upper col., line 8 from bottom to p. 38, last line. | p. 30, left upper col., lines 1 to 13. | p. 47, lines 10 to 15. |
| Emulsion stabilizer | p. 39, left upper col., line 1 to p. 72, right upper col., last line. | p. 30, left upper col., line 14 to right upper col., line 1. | p. 47, lines 16 to 19. |
| Development accelerator | p. 72, left lower col., line 1 to p. 91, right upper col., line 3. | | |
| Color coupler (cyan, magenta and cyan couplers) | p. 91, right upper col., line 4 to p. 121, left upper col., line 6. | p. 3, right upper col., line 14 to p. 18, left upper col., last line, and p. 30, right upper col., line 6 to p. 35 right lower col., line 11. | p. 4 lines 15 to 27, p. 5, line 30 to p. 28, last line, p. 45, lines 29 to 31, and p. 47, line 23 to p. 63, line 50. |
| Color forming accelerator | p. 121, left upper col., line 7 to p. 125, right upper col., line 1. | | |
| UV absorber | p. 125, right upper col., line 2 to p. 127, left lower col., last line. | p. 37, right lower col., line 14 to p. 38, left upper col., line 11. | p. 65, lines 22 to 31. |
| Anti-fading agent (an image stabilizer) | p. 127, right lower col., line 1 to p. 137, left lower col., line 8. | p. 36, right upper col., line 12 to p. 37, left upper col., line 19. | p. 4, line 30 to p. 5, line 23, p. 29, line 1 to p. 45, line 25, p. 45, lines 33 to 40, and p. 65, lines 2 to 21. |
| High boiling | p. 137, left lower col., | p. 35, right lower col., | p. 64, lines 1 to 51. |

-continued

| Photographic elements | JP-A-62-215272 | JP-A-2-33144 | EP 0 335 660 A2 |
|---|---|---|---|
| and/or low boiling organic solvent | line 9 to p. 144, right upper col., last line | line 14 to p. 36, left upper col., line 4 from bottom. | |
| Method for dispersing photographic additives | p. 144, left lower col., line 1 to p. 146, right upper col., line 7. | p. 27, right lower col., line 10 to p. 28, left upper col., last line, and p. 35, right lower col., line 12 to p. 36, right upper col., line 7. | p. 63, line 51 to p. 64, line 56. |
| Hardener | p. 146, right upper col., line 8 to p. 155, left lower col., line 4. | | |
| Precursor of a developing agent | p. 155, left lower col., line 5 to right lower col., line 2. | | |
| Development inhibitor-releasing compound | p. 155, right lower col., lines 3 to 9. | | |
| Support | p. 155, right lower col., line 19, to p. 156, left upper col., line 14. | p. 38, right upper col., line 18 to p. 39, left upper col., line 3. | p. 66, line 29 to p. 67, line 13. |
| Light-sensitive layer structure | p. 156, left upper col., line 15 to right lower col., line 14. | p. 28, right upper col., lines 1 to 15. | p. 45, lines 41 to 52. |
| Dye | p. 156, right lower col., line 15 to p. 184, right lower col., last line. | p. 38, left upper col., line 12 to right upper col., line 7. | p. 66, lines 18 to 22. |
| Anti-color mixing agent | p. 185, left upper col., line 1 to p. 188, right lower col., line 3. | p. 36, right upper col., lines 8 to 11. | p. 64, line 57 to p. 65, line 1. |
| Gradation controller | p. 188, right lower col., lines 4 to 8. | | |
| Anti-stain agent | p. 188, right lower col., line 9 to p. 193, right lower col., line 10. | p. 37, left upper col., last line to right lower col., line 13. | p. 65, line 32 to p. 66, line 17. |
| Surface active agent | p. 201, left lower col., line 1 to p. 210, right upper col., last line | p. 18, right upper col., line 1 to p. 24, right lower col., last line, and p. 27, left lower col., line 10 from bottom to right lower col., line 9. | |
| Fluorinated compound (anti-electrification agent, coating aid, lubricant and anti-adhesion agent) | p. 210, left lower col., line 1 to p. 222, left lower col., line 5. | p. 25, left upper col., line 1 to p. 27, right lower col., line 9. | |
| Binder (hydrophilic colloid) | p. 222, left lower col., line 6 to p. 225, left upper col., last line. | p. 38, right upper col., lines 8 to 18. | p. 66, lines 23 to 28. |
| Thickner | p. 255, right upper col., line 1 to p. 227, right upper col., line 2. | | |
| Anti-electrification agent | p. 227, right upper col., line 3 to p. 230, left upper col., line 1. | | |
| Polymer latex | p. 230, left upper col., line 2 to p. 239, last line. | | |
| Matting agent | p. 240, left upper col., line 1 to right upper col., last line. | | |
| Photographic processing method (processing steps and additives) | p. 3, right upper col., line 7 to p. 10, right upper col., line 5. | p. 39, left upper col., line 4 to p. 42, left upper col., last line. | p. 67, line 14 to p. 69, line 28. |

Remarks:
1. There is included in the cited items of JP-A-62-215272, the content amended according to the Amendment dated March 16, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

Further, the method described in the left upper column of page 27 to the right upper column of page 34 of JP-A-2-207250 is preferably applied as the method for processing a silver halide color light-sensitive material containing a high silver chloride emulsion having a silver chloride content of 90 mole % or more.

EXAMPLES

The present invention will be explained below with reference to the examples, but is not limited thereto.

EXAMPLE 1

A paper support laminated on the both sides thereof with polyethylene, which was subjected to a corona discharge treatment, was provided with a gelatin subbing layer containing sodium dodecylbenzenesulfonate, and further was coated with the various photographic constitutional layers, whereby a multilayered color photographic paper (Sample A) having the following layer constitution was prepared. The coating solutions were prepared in the following manner.

Preparation of the fifth layer coating solution

Ethyl acetate (50.0 ml) and a solvent (Solv-6) (14.0 g) were added to a cyan coupler (ExC) (32.0 g), a dye image stabilizer (Cpd-2) (3.0 g), a dye image stabilizer (Cpd-4) (2.0 g), a dye image stabilizer (Cpd-6) (18.0 g), a polymer (P-61) 40.0 g, and a dye image stabilizer (Cpd-8) (5.0 g) to dissolve them. This solution was added to 500 ml of a 20% gelatin aqueous solution containing sodium dodecylbenzene-sulfonate (8 ml), and then was dispersed with a supersonic homogenizer to thereby prepare an emulsified dispersion.

Meanwhile, there was prepared a silver chlorobromide emulsion (cube, a 1:4 mixture by Ag mole ratio of a large size emulsion with an average grain size of 0.58 μm and a small size emulsion with an average grain size of 0.45 μm, wherein the variation coefficients (obtained by dividing the standard deviation by average particle size) were 0.09 and 0.11, respectively, and both size emulsions contained grains in which AgBr 0.6 mol % was partially located on the surface thereof). Added to this emulsion was the following red-sensitive sensitizing dye E in an amount of $0.9\times10^{-4}$ mole per mole of silver based on the large size emulsion and $1.1\times10^{-4}$ mole per mole of silver based on the small size emulsion. Further, this emulsion was subjected to a chemical ripening after adding a sulfur sensitizer and a gold sensitizer. The foregoing emulsified dispersion and this red-sensitive silver chlorobromide emulsion were mixed and dissolved, whereby a fifth layer coating solution was prepared so that it was of the following composition.

The coating solutions for the 1st layer to 4th layer, the 6th layer and the 7th layer were prepared in a similar manner as the 5th layer coating solution. H-1 and H-2 were used as a gelatin hardener for the respective layers. Further, Cpd-10 and Cpd-11 were added to the respective layers so that the entire amounts thereof became 25.0 mg/m$^2$ and 50.0 mg/m$^2$, respectively.

The following spectral sensitizing dyes were used for the silver chlorobromide emulsions contained in the respective light-sensitive emulsion layers.

Blue-sensitive emulsion layer Sensitizing dye A

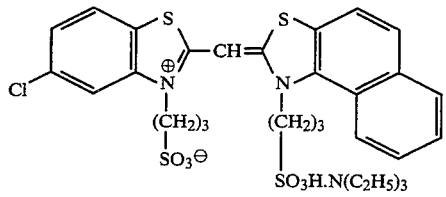

and Sensitizing dye B

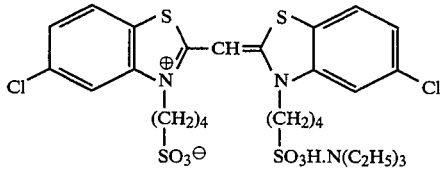

(each $2.0\times10^{-4}$ mole per mole of silver halide to the large size emulsion and $2.5\times10^{-4}$ mole per mole of silver halide to the small size emulsion).

Green-sensitive emulsion layer

Sensitizing dye C

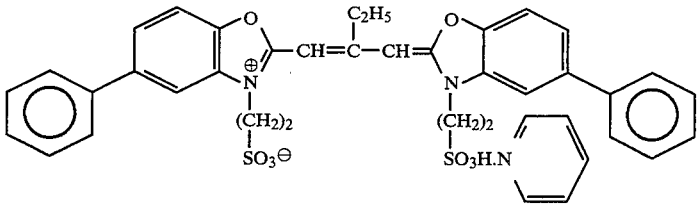

($4.0\times10^{-4}$ mole per mole of silver halide to the large size emulsion and $5.6\times10^{-4}$ mole per mole of silver halide to the small size emulsion), and Sensitizing dye D

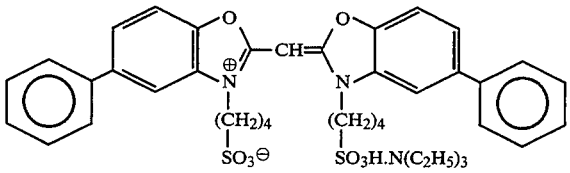

($7.0\times10^{-5}$ mole per mole of silver halide to the large size emulsion and $1.0\times10^{-5}$ mole per mole of silver halide to the small size emulsion).

Red-sensitive emulsion layer.

Sensitizing dye E

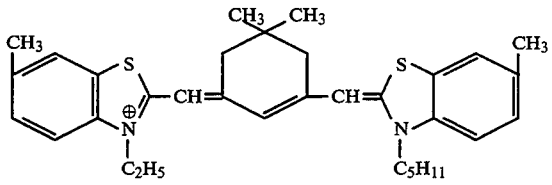

$I^{\ominus}$ ($0.9\times10^{-4}$ mole per mole of silver halide to the large size emulsion and $1.1\times10^{-4}$ mole per mole of silver halide to the small size emulsion).

Further, the following compound was added in an amount of $2.6\times10^{-3}$ mole per mole of silver halide to red-sensitive emulsion layer.

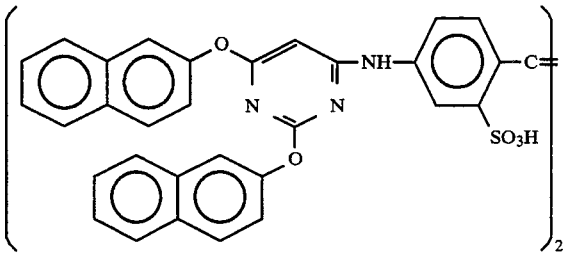

Further there was added to the blue-sensitive layer, green-sensitive layer and red-sensitive layer, 1-(5-methylureidophenyl)-5-mercaptotetrazole in the amounts of $8.5\times10^{-5}$ mole, $7.7\times10^{-4}$ mole and $2.5\times10^{-4}$ mole per mole of silver halide, respectively.

Further there was added to the blue-sensitive layer and green-sensitive layer, 4-hydroxy-6-methyl-1,3,3a,7-tetrazaindene in the amounts of $1\times10^{-4}$ mole and $2\times10^{-4}$ mole per mole of silver halide, respectively.

The following dyes ( the number in the parenthesis represents a coated amount) were added to an emulsion layer for preventing irradiation:

First layer (a blue-sensitive emulsion layer)

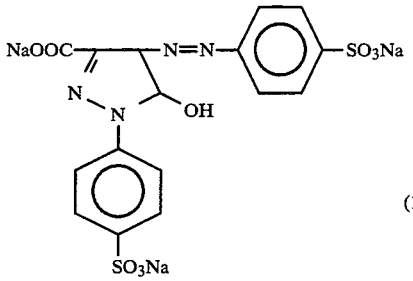

(10 mg/m$^2$)

Third layer (a green-sensitive emulsion layer)

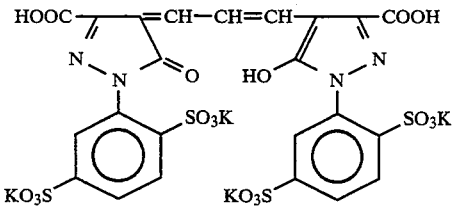

(10 mg/m$^2$)

Fifth layer (a red-sensitive emulsion layer)

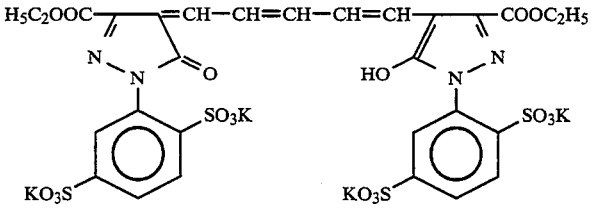

(40 mg/m$^2$)

and

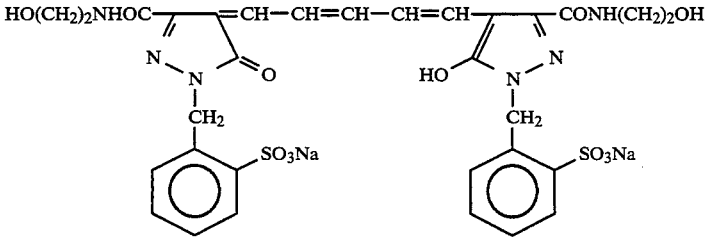

(20 mg/m$^2$)

Layer constitution

The compositions of the respective layers are shown below. The numbers represent the coated amounts (g/m$^2$). The coated amounts of the silver halide emulsions are expressed in terms of the amounts converted to silver.

Support:

Polyethylene laminated paper (polyethylene coated on the 1st layer side contains a white pigment/$TiO_2$ and a blue dye/ultramarine).

| First layer: a blue-sensitive emulsion layer | |
|---|---|
| Silver chlorobromide emulsion | 0.26 |

-continued

| | |
|---|---|
| (cube; 3:7 mixture (silver mole ratio) of a large size emulsion having an average grain size of 0.88 mm and a small size emulsion having an average grain size of 0.70 μm, wherein the variation coefficients of the grain size distributions are 0.08 and 0.10, respectively, and both size emulsions contained the grains in which AgBr 0.3 mole % was partially located on the surface thereof) | |
| Gelatin | 1.52 |
| Yellow coupler (ExY) | 0.48 |
| Dye image stabilizer (Cpd-1) | 0.19 |
| Solvent (Solv-3) | 0.18 |
| Solvent (Solv-7) | 0.18 |
| Dye image stabilizer (Cpd-9) | 0.04 |
| Stabilizer (Cpd-12) | 0.01 |
| Second layer: a color mixing prevention layer | |
| Gelatin | 0.99 |
| Color mixing prevention agent (Cpd-5) | 0.08 |
| Solvent (Solv-1) | 0.16 |
| Solvent (Solv-4) | 0.08 |
| Third layer: a green-sensitive emulsion layer | |
| Silver chlorobromide emulsion (cube; 1:3 mixture (silver mole ratio) of a large size emulsion having an average grain size of 0.55 μm and a small size emulsion having an average grain size of 0.39 μm, wherein the variation coefficients of the grain size distributions are 0.10 and 0.08, respectively, and both size emulsions contained the grains in which AgBr 0.8 mole % was partially located on the surface thereof) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |

-continued

| | |
|---|---|
| Fourth layer: a UV absorbing layer | |
| Gelatin | 1.58 |
| UV absorber (UV-1) | 0.47 |
| Color mixing prevention agent (Cpd-5) | 0.05 |
| Solvent (Solv-5) | 0.24 |
| Fifth layer: a red-sensitive emulsion layer | |
| Silver bromochloride emulsion (cube; 1:4 mixture (silver mole ratio) of a large size emulsion having an average grain size of 0.58 μm and a small size emulsion having an average grain size of 0.45 μm, wherein the variation coefficients of the grain size distributions are 0.09 and 0.11, respectively, and both size emulsions contained the grains in which AgBr 0.6 mol % was partially located on the surface thereof) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Polymer (P-61) | 0.40 |
| Dye image stabilizer (Cpd-8) | 0.05 |
| Solvent (Solv-6) | 0.14 |
| Sixth layer: a UV absorbing layer | |
| Gelatin | 0.53 |
| UV absorber (UV-1) | 0.16 |
| Color mixing prevention agent (Cpd-5) | 0.02 |
| Solvent (Solv-5) | 0.08 |
| Seventh layer: a protective layer | |
| Gelatin | 1.33 |
| Acryl-modified copolymer of polyvinyl alcohol (a modification degree: 17%) | 0.17 |
| Liquid paraffin) | 0.03 |

The compounds used in this Example are shown below:

Yellow coupler (ExY)

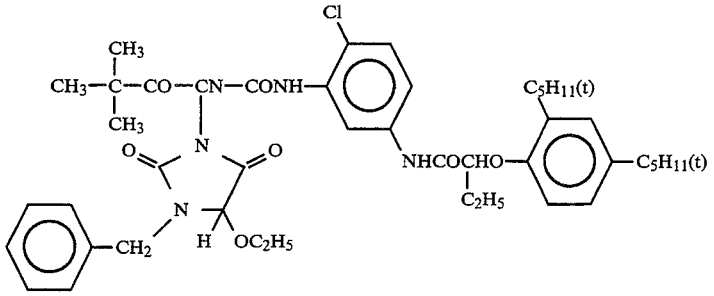

Magenta coupler (ExM)

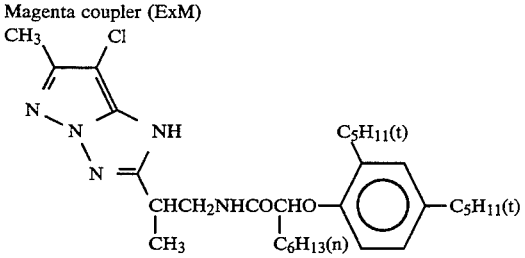

Cyan coupler (ExC)
A 2:3:5 mixture (mole ratio) of:

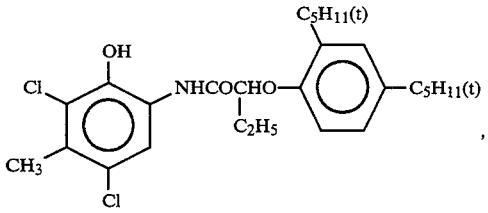

-continued
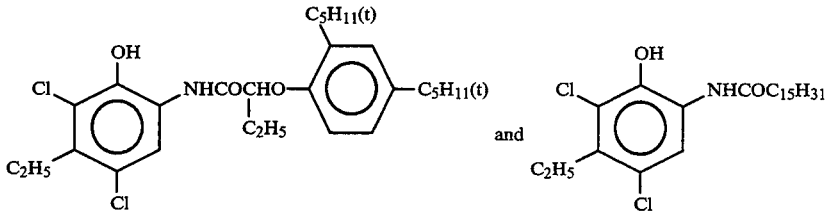
Dye image stabilizer (Cpd-1)
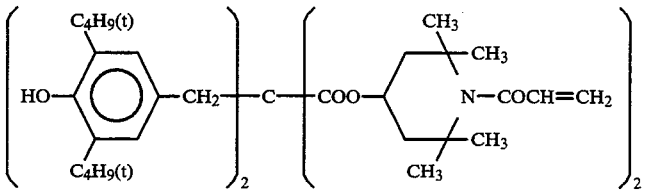
Dye image stabilizer (Cpd-2)
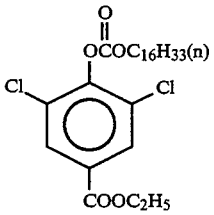
Dye image stabilizer (Cpd-3)
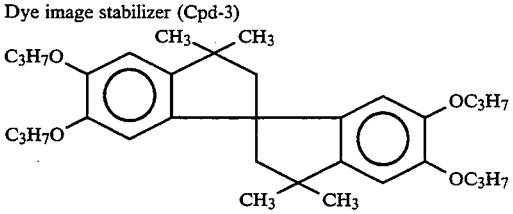
Dye image stabilizer (Cpd-4)
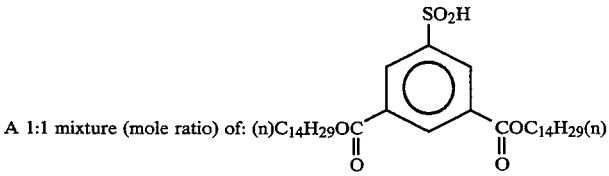
and
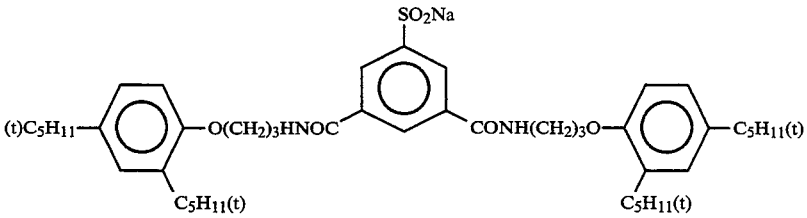
Dye image stabilizer (Cpd-5)
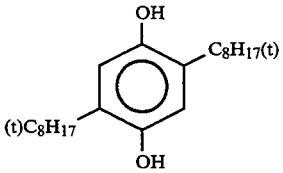
Dye image stabilizer (Cpd-6)
A 2:4:4 mixture (weight ratio) of:

-continued
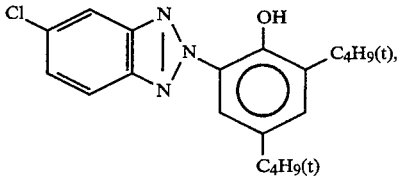
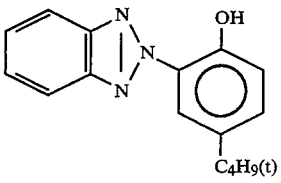
and
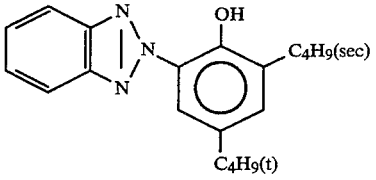
Dye image stabilizer (Cpd-8)
A 1:1 mixture (weight ratio) of:
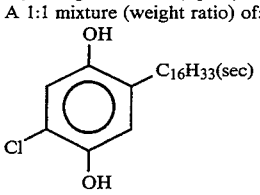
and
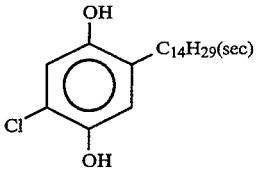
Dye image stabilizer (Cpd-9)
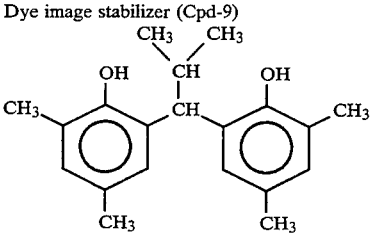
Preservative (Cpd-10)
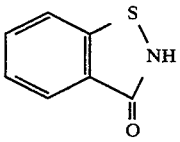
Preservative (Cpd-11)
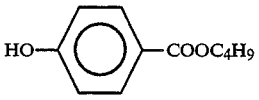
Stabilizer (Cpd-12)
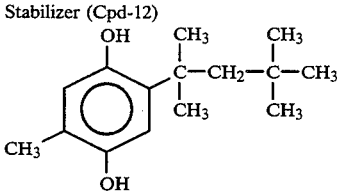
UV absorber (UV-1)
A 4:2:4 mixture (weight ratio) of:
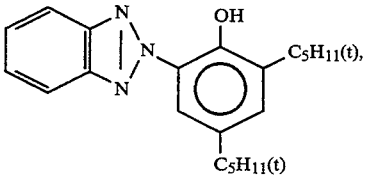
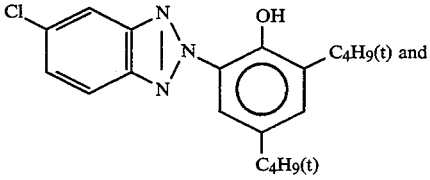
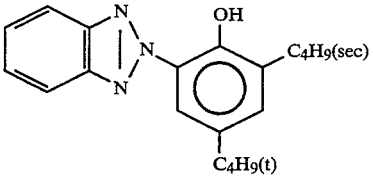

-continued (H-1)

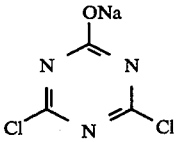

(H-2)

$CH_2{=}CH{-}SO_2{-}CH_2{-}CONH{-}CH_2$
$CH_2{=}CH{-}SO_2{-}CH_2{-}CONH{-}CH_2$

Solvent (Solv-1)

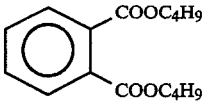

Solvent (Solv-2)
A 1:1 mixture (weight ratio) of:

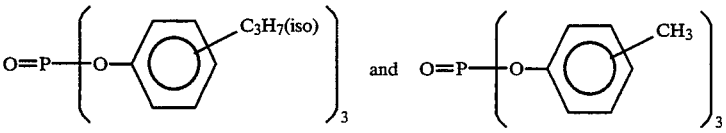

Solvent (Solv-3)

$O{=}P{-}(O{-}C_9H_{19}(iso))_3$

Solvent (Solv-4)

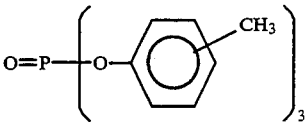

Solvent (Solv-5)

$COOC_8H_{17}$
$(CH_2)_8$
$COOC_8H_{17}$

Solvent (Solv-6)
A 80:20 mixture (volume ratio) of:

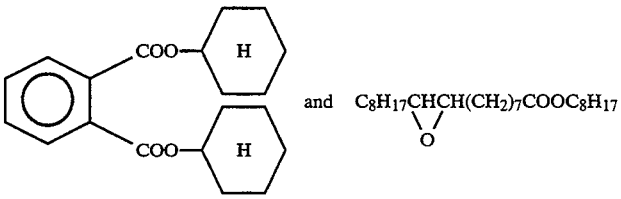

Solvent (Solv-7)

$C_8H_{17}CHCH(CH_2)_7COOC_8H_{17}$
O

Next, light-sensitive material Samples B to U were prepared in the same manner as Sample A, except that the cyan coupler (ExC) contained in the fifth layer (red-sensitive layer) was replaced with the cyan couplers as shown in Table A below and that polymer (P-61) was added or not added as shown in Table A.

The respective samples thus obtained were subjected to a gradational exposure via a three colors separation filter for sensitometry with a sensitometer (FWH type, a color temperature of a light source: 3200° K., manufactured by Fuji Photo Film Co., Ltd.), wherein the exposure was given so that an exposure became 250 CMS at an exposing time of 0.1 second.

The exposed samples were subjected to processing by the following steps with a paper processing machine with processing solutions having the following compositions.

| Processing step | Temperature | Time |
|---|---|---|
| Color developing | 35° C. | 45 seconds |
| Bleach/fixing | 30 to 34° C. | 45 seconds |
| Rinsing 1 | 30 to 34° C. | 20 seconds |
| Rinsing 2 | 30 to 34° C. | 20 seconds |
| Rinsing 3 | 30 to 34° C. | 20 seconds |

-continued

| Processing step | Temperature | Time |
|---|---|---|
| Drying | 70 to 80° C. | 60 seconds |

The compositions of the respective processing solutions are as follows:

| | Tank solution |
|---|---|
| Color developing solution | |
| Water | 800 ml |
| Ethylenediamine-N,N,N,N-tetramethylene-phosphonic acid | 1.5 g |
| Potassium bromide | 0.015 g |
| Triethanolamine | 8.0 g |
| Sodium chloride | 1.4 g |
| Potassium carbonate | 25 g |
| N-ethyl-N-(β-methanesulfonamideethyl)-3-methyl-4-aminoaniline sulfate | 5.0 g |
| N,N-bis(carboxymethyl) hydrazine | 4.0 g |
| Sodium N,N-di(sulfoethyl) hydroxylamine | 4.0 g |
| Fluorescent whitening agent (Whitex 4B manufactured by Sumitomo Chem. Ind. Co., Ltd.) | 1.0 g |
| Water was added to | 1000 ml |
| pH (25° C.) | 10.05 |

-continued

| Tank solution | |
|---|---|
| Bleach/fixing solution | |
| Water | 400 ml |
| Ammonium thiosulfate (700 g/liter) | 100 ml |
| Sodium sulfite | 17 g |
| Iron (III) ammonium ethylene-diaminetetracetate | 55 g |
| Disodium ethylenediaminetetracetate | 5 g |
| Ammonium bromide | 40 g |
| Water was added to | 1000 ml |
| pH (25° C.) | 6.0 |

Rinsing solution

Deionized water (amounts of calcium ions and magnesium ions: each 3 ppm or lower)

The respective samples thus processed were subjected to a measurement of a reflection density with a TCD type densitometer manufactured by Fuji Photo Film Co., Ltd. to obtain the maximum densities.

Further, the maximum density and light fastness of each color were measured in the following manners:

Light fastness

Irradiation by sun light for 60 days (an underglass outdoor balcony was used).

The fastness was represented by measuring density after irradiation as a percentage (%) of an initial density ($D_0$)=1.0 obtained before irradiation.

Each of the samples was exposed via a color negative film photographing cloths of various colors and similarly processed as the samples subjected to a gradational exposure via a three colors separation filter for sensitometry. The samples subjected to the irradiation of sun light for 60 days (an underglass outdoor balcony used) were evaluated with respect to color reproducibility. The evaluation was judged by superiority or inferiority of the color reproduction (hue and chroma) by visual observation as compared with that of a fresh Sample A (comparison) which had not been subjected to irradiation. The color reproducibility is shown in Table A as being either identical, inferior or superior to that of the fresh sample (Fr) of Sample A. The results are shown in Table A.

TABLE A

| Sample No. | Cyan coupler | Polymer kind | Color reproducibility (Fr/after irradiation) Cyan | Blue | Green | Cyan maximum density | Cyan light fastness (%) |
|---|---|---|---|---|---|---|---|
| A (Comp.) | ExC | P-61 | —/C | —/C | —/C | 2.25 | 84 |
| B (Comp.) | ExC | P-172 | B/C | B/C | B/C | 2.23 | 82 |
| C (Comp.) | ExC | — | B/B | B/C | B/B | 2.25 | 80 |
| D (Inv.) | C-3 | P-61 | A/B | A/B | A/B | 2.58 | 95 |
| E (Comp.) | C-3 | — | A/B | A/C | A/B | 2.59 | 78 |
| F (Inv.) | C-3 | P-3 | A/B | A/B | A/B | 2.59 | 90 |
| G (Inv.) | C-3 | P-172 | A/B | A/B | A/B | 2.59 | 92 |
| H (Inv.) | C-16 | P-61 | A/A | A/A | A/B | 2.64 | 97 |
| I (Comp.) | C-16 | — | A/B | A/C | A/B | 2.65 | 80 |
| J (Inv.) | C-16 | P-63 | A/B | A/B | A/B | 2.66 | 92 |
| K (Inv.) | C-16 | P-64 | A/B | A/B | A/B | 2.65 | 93 |
| L (Inv.) | C-19 | P-61 | A/A | A/A | A/B | 2.64 | 98 |
| M (Comp.) | C-19 | — | A/B | A/C | A/B | 2.63 | 78 |
| N (Inv.) | C-4 | P-61 | A/A | A/A | A/B | 2.59 | 97 |
| O (Comp.) | C-4 | — | A/B | A/C | A/B | 2.58 | 77 |
| P (Inv.) | C-29 | P-61 | A/B | A/B | A/B | 2.57 | 96 |
| Q (Inv.) | C-24 | P-61 | A/A | A/A | A/B | 2.50 | 95 |
| R (Comp.) | C-24 | — | A/B | A/C | A/B | 2.49 | 78 |
| S (Inv.) | C-36 | P-61 | A/B | A/B | A/B | 2.46 | 94 |
| T (Inv.) | C-36 | P-57 | A/B | A/B | A/B | 2.46 | 94 |
| U (Inv.) | C-45 | P-61 | A/B | A/B | A/B | 2.40 | 93 |

Color reproducibility: C: inferior to Fr of Sample A, B: identical to Fr of Sample A, A: superior to Fr of Sample A.

The weight-average molecular weight of P-61, P-172, P-3, P-63, P-64 and P-57 is 30,000, 25,000, 25,000, 30,000, 25,000, and 25,000, respectively.

As can be seen from the results summarized in Table A, the light-sensitive materials of the present invention have excellent color reproducibility and have achieved a high color-forming property and light fastness.

Samples D, F to H, J, L, N, P, Q, S, T and U were subjected to an inspection of heat fastness (after storage at 30° C. and 70% RH for 30 days), and it was found that they have excellent heat fastness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one silver halide emulsion layer having a cyan color-forming property, wherein the silver halide emulsion layer having the cyan color-forming property is a red-sensitive silver halide emulsion layer which contains at least one cyan coupler represented by the following formula (I-a) or (II-a) and at least one of a sparingly water-soluble homopolymer and/or copolymer:

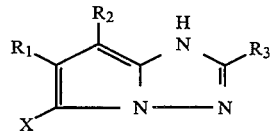

(I-a)

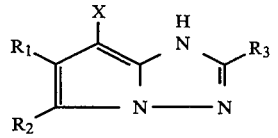

(II-a)

wherein $R_1$ and $R_2$ each are an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; and X represents a hydrogen atom or a group capable of splitting off upon a reaction with an oxidation product of an aromatic primary amine color developing agent.

2. The silver halide color photographic light-sensitive material of claim 1, wherein $R_3$ represents a hydrogen atom, a halogen atom, an alkyl group, an aryl group, a heterocyclic group, a cyano group, a hydroxy group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, or an azolyl group.

3. The silver halide color photographic light-sensitive material of claim 1, wherein $R_1$ and $R_2$ each independently represents an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having $\sigma_p$ of 0.20 or more, a heterocyclic group, a halogen atom, an azo group, or a selenocyanato group.

4. The silver halide color photographic light-sensitive material of claim 1, wherein X represents a hydrogen atom, a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino group, a 5-membered or 6-membered nitrogen-containing heterocyclic group, an imido group, or an arylazo group.

5. The silver halide color photographic light-sensitive material of claim 1, wherein the cyan coupler is represented by formula (I-a)

6. The silver halide color photographic light-sensitive material of claim 1, wherein the amount of cyan couplers present in the light-sensitive material is $1\times10^{-3}$ mole to 1 mole per mole of silver halide in said silver halide emulsion layer.

7. The silver halide color photographic light-sensitive material of claim 1, wherein the sparingly water-soluble and organic solvent-soluble polymer has a repeating unit containing an acid group on a main chain or a side chain, and the amount of the repeating unit is 20 mole % or less to the overall repeating units.

8. The silver halide color photographic light-sensitive material of claim 1, wherein $R_1$ is a cyano group and $R_2$ is a branched alkoxycarbonyl group.

9. The silver halide color photographic light-sensitive material of claim 1, wherein X is a halogen atom, or an alkyl or arylthio group.

10. The silver halide color photographic light-sensitive material of claim 1, wherein $R_3$ is an alkyl group or an aryl group.

11. The silver halide color photographic light-sensitive material of claim 10, wherein $R_3$ is an alkyl group or aryl group each having at least one alkoxy group, sulfonyl group, sulfamoyl group, carbamoyl group, acylamido group, or sulfonamido group.

12. The silver halide color photographic light-sensitive material of claim 1, wherein said sparingly water-soluble polymer is a polymer having a —C(=O)NHR group, wherein R represents a substituted or unsubstituted alkyl or aryl group having a total carbon number of 3 to 12.

13. The silver halide color photographic light-sensitive material of claim 1, wherein the sparingly water-soluble polymers have a weight-average molecular weight of 30,000 or less.

14. The silver halide color photographic light-sensitive material of claim 1, wherein the sparingly water-soluble polymers is a homopolymer.

15. The silver halide color photographic light-sensitive material of claim 1, wherein the weight ratio of the sparingly water-soluble polymers to the cyan coupler represented by formula (I-a) or (II-a) is 1:20 to 20: 1.

* * * * *